US010383204B2

(12) United States Patent
Hara et al.

(10) Patent No.: US 10,383,204 B2
(45) Date of Patent: Aug. 13, 2019

(54) SUPERCONDUCTING ACCELERATOR

(71) Applicant: MITSUBISHI HEAVY INDUSTRIES MACHINERY SYSTEMS, LTD., Hyogo (JP)

(72) Inventors: Hiroshi Hara, Tokyo (JP); Katsuya Sennyu, Tokyo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 41 days.

(21) Appl. No.: 15/739,141

(22) PCT Filed: Feb. 18, 2016

(86) PCT No.: PCT/JP2016/054710

§ 371 (c)(1),
(2) Date: Dec. 21, 2017

(87) PCT Pub. No.: WO2017/002389

PCT Pub. Date: Jan. 5, 2017

(65) Prior Publication Data

US 2019/0090342 A1 Mar. 21, 2019

(30) Foreign Application Priority Data

Jun. 30, 2015 (JP) ..... 2015-131089

(51) Int. Cl.
*H05H 7/20* (2006.01)
*H05H 7/22* (2006.01)
*H05H 9/04* (2006.01)

(52) U.S. Cl.
CPC ..... *H05H 7/20* (2013.01); *H05H 7/22* (2013.01); *H05H 9/041* (2013.01); *H05H 9/048* (2013.01); *H05H 2007/222* (2013.01)

(58) Field of Classification Search
None
See application file for complete search history.

(56) References Cited

U.S. PATENT DOCUMENTS 8,042,258 B2 * 10/2011 Sennyu ..... H05H 7/20 29/599
8,630,689 B2 * 1/2014 Sennyu ..... H05H 7/20 505/200

(Continued)

FOREIGN PATENT DOCUMENTS

CN 103874255 A 6/2014
JP 3-15199 A 1/1991

(Continued)

OTHER PUBLICATIONS

International Search Report in PCT/JP2016/054710, dated Mar. 22, 2016. 3pp.

(Continued)

*Primary Examiner* — Dion Ferguson
*Assistant Examiner* — Srinivas Sathiraju
(74) *Attorney, Agent, or Firm* — Kanesaka Berner and Partners, LLP

(57) ABSTRACT

A superconducting accelerator includes an acceleration cavity, and a refrigerant tank at an outer circumference of the acceleration cavity. The gap between the refrigerant tank and the acceleration cavity is filled with a refrigerant for cooling the acceleration cavity. A pair of pressing members is provided to an outer circumference of the refrigerant tank to be positioned at both side ends of the acceleration cavity in a direction of a beam axis of the charged particle beam or at both ends of the acceleration cavity in a direction perpendicular to the beam axis. A wire is continuously wound around the outer circumference of the refrigerant tank and configured to generate a tensile force in a direction in which the pressing members are brought come into close each other. A tension adjustor is configured to adjust the tensile force generated by the wire.

13 Claims, 18 Drawing Sheets

(56) References Cited

U.S. PATENT DOCUMENTS

| | | | | |
|---|---|---|---|---|
| 8,872,446 | B2 * | 10/2014 | Tsubota | B23K 26/0626 219/121.6 |
| 8,883,690 | B2 * | 11/2014 | Sennyu | B23K 26/206 219/121.64 |
| 8,951,936 | B2 * | 2/2015 | Sennyu | B23K 15/04 505/480 |
| 8,957,348 | B2 * | 2/2015 | Sennyu | B23K 26/0823 219/121.63 |
| 9,055,659 | B2 * | 6/2015 | Hitomi | B21D 51/16 |
| 9,358,638 | B2 * | 6/2016 | Hori | B23K 26/24 |
| 9,497,847 | B2 * | 11/2016 | Sennyu | H05H 7/20 |
| 10,035,229 | B2 * | 7/2018 | Horie | H05H 7/20 |
| 2002/0190670 | A1 | 12/2002 | Pappo et al. | |
| 2007/0275860 | A1 * | 11/2007 | Sennyu | H05H 7/20 505/400 |
| 2010/0301782 | A1 | 12/2010 | Yamamoto et al. | |
| 2012/0100994 | A1 * | 4/2012 | Sennyu | B23K 26/206 505/480 |
| 2012/0256563 | A1 * | 10/2012 | Tsubota | B23K 26/0626 315/501 |
| 2013/0008021 | A1 * | 1/2013 | Hitomi | B21D 51/16 29/825 |
| 2013/0012394 | A1 * | 1/2013 | Sennyu | H05H 7/20 505/200 |
| 2013/0012397 | A1 * | 1/2013 | Sennyu | B23K 15/04 505/300 |
| 2013/0026142 | A1 * | 1/2013 | Sennyu | B23K 26/0823 219/121.63 |
| 2014/0361859 | A1 | 12/2014 | Mitsubori | |
| 2015/0163894 | A1 * | 6/2015 | Hara | C25F 3/26 315/501 |
| 2015/0251369 | A1 | 9/2015 | Takagi | |
| 2018/0153028 | A1 * | 5/2018 | Hara | G12B 17/04 |
| 2019/0090342 | A1 * | 3/2019 | Hara | H05H 7/20 |

FOREIGN PATENT DOCUMENTS

| | | | |
|---|---|---|---|
| JP | H4-345799 | A | 12/1992 |
| JP | H5-13032 | A | 1/1993 |
| JP | 7-95480 | B2 | 10/1995 |
| JP | 8-330098 | A | 12/1996 |
| JP | H9-54807 | A | 2/1997 |
| JP | H11-20742 | A | 1/1999 |
| JP | 2010-277942 | A | 12/2010 |
| JP | 2012-28090 | A | 2/2012 |
| JP | 2013-44262 | A | 3/2013 |
| WO | 2013/190667 | A1 | 12/2013 |

OTHER PUBLICATIONS

Written Opinion of the International Searching Authority in PCT/JP2016/054710, dated Mar. 22, 2016. 7pp.

Z.A. Conway et al., "A New Half-Wave Resonator Cryomodule Design for Project-X*", Proceedings of IPAC2012, vol. 3867, Jul. 1, 2012, pp. 3865-3867, New Orleans, Louisiana, USA.

Myung Ook Hyun et al. "Design and Analysis of Slow Tuner in the Superconducting Cavity of RISP", Proceedings of LINAC2014, Dec. 1, 2014, pp. 616-618, Geneva, Switzerland.

Zachary A. Conway, "Innovative Tuner Designs for Low-beta SRF Cavities", Argonne National Laboratory, Physics Division-Linac Development Group, Jan. 1, 2012, pp. 1-22, Retrieved from the Internet, URL: https://accelconf.web.cern.ch/accelconf/SRF2011/talks/frioa02_talk.pdf [retrieved on Dec. 14, 2018].

Z.A. Conway et al., "Innovative Tuning Technique for Low-beta SRF Cavities", Proceedings of SRF2011, vol. 945, Jun. 1, 2012, pp. 943-945, Chicago, Illinois, USA.

* cited by examiner

SUPERCONDUCTING ACCELERATOR

RELATED APPLICATIONS

The present application is a National Phase of PCT/JP2016/054710 filed Feb. 18, 2016, and claims priority from Japanese Patent Application No. 2015-131089 filed Jun. 30, 2015.

TECHNICAL FIELD

The present invention relates to a superconducting accelerator. Priority is claimed on Japanese Patent Application No. 2015-131089, filed Jun. 30, 2015, the content of which is incorporated herein by reference.

BACKGROUND ART

A superconducting accelerator that accelerates charged particles such as electrons or protons using a superconductive acceleration cavity is known. A superconducting accelerator makes a superconductive acceleration cavity, which is formed of a superconducting material, superconductive by cooling the superconductive acceleration cavity using a refrigerant such as liquid helium. Accordingly, the electrical resistance of the superconductive acceleration cavity becomes almost zero and thus charged particles can be efficiently accelerated without power loss.

In such a superconducting accelerator, a resonance frequency of the superconductive acceleration cavity is tuned by adjusting the length of a gap in which a high-frequency electric field for accelerating charged particles is formed in the superconductive acceleration cavity.

Patent Document 1 discloses a configuration in which the length in an axial direction of a refrigerant tank that accommodates a superconductive acceleration cavity is adjusted by changing the distance between two flanges which are disposed in the refrigerant tank. In this configuration, by providing a wedge-shaped nut having a tapered surface between seat plates which are in close contact with the two flanges and moving the nut along the surfaces of the seat plates using a bolt, a gap between the seat plates is adjusted.

A resonance frequency tuning method using beam members having a length larger than the diameter of the refrigerant tank and provided on both sides of the superconductive acceleration cavity in a diameter direction of the refrigerant tank has been proposed. Here, one end of one of the beam members is connected to that of the other of the beam members with a screw member attached to one side of the refrigerant tank in the diameter direction, also the other end of one of the beam members is connected to that of the other of the beam members with another screw member attached to the other side of the refrigerant tank. According to this method, by changing a gap between the beam members using the screw members, the superconductive acceleration cavity is deformed to change the length of a particle passage and it is thus possible to tune the resonance frequency of the superconductive acceleration cavity.

PRIOR ART DOCUMENTS

Patent Document

Patent Document 1: Japanese Unexamined Patent Application, First Publication No. 2012-028090

SUMMARY OF INVENTION

Technical Problem

The resonance frequency tuning method changes the length in the axial direction of the refrigerant tank as a whole by moving the wedge-shaped nut disposed between the two seat plates along the surfaces of the seat plates. Accordingly, a large force is applied to the seat plates or the nuts. Accordingly, the seat plates or the nuts have to be strong. Then, the seat plates or the nuts increase in size and an increase in costs and size of the superconducting accelerator is caused. When a second device or the like are provided in the vicinity of the seat plates or the nuts, the second device has to be laid out such that the device does not interference with the seat plates or the nuts, and such work requires time.

In the configuration in which the gap between the beam members provided at both ends of the refrigerant tank is changed using the screw members, a bending moment is applied to the beam members when the gap between the beam members is changed using the screw member. In order to resist the bending moment, the beam members have to be strong and thus an increase in costs and size of the superconducting accelerator, an increase in labor for layout work for avoiding interference with another device, and the like are caused as in the configuration disclosed in Patent Document 1.

An object of the invention is to provide a superconducting accelerator in which a resonance frequency of a superconductive acceleration cavity can be satisfactorily tuned and a decrease in costs, a decrease in size of the superconducting accelerator, and a decrease in labor for a layout operation can be achieved.

Solution to Problem

According to a first aspect of the invention, a superconducting accelerator includes an acceleration cavity in which a space to accelerate a charged particle beam in a superconductive state is formed, and a refrigerant tank positioned at an outer circumference of the acceleration cavity, a gap between the refrigerant tank and the acceleration cavity accommodated in the refrigerant tank being filled with a refrigerant for cooling the acceleration cavity. Also, the superconducting accelerator includes a pair of pressing members provided to an outer circumference of the refrigerant tank so as to be respectively positioned at both side ends of the acceleration cavity in a direction of a beam axis of the charged particle beam or at both ends of the acceleration cavity in a direction perpendicular to the beam axis. The superconducting accelerator further includes a tensile member provided so as to be continuously wound around the outer circumference of the refrigerant tank and configured to generate a tensile force in a direction in which the pressing members are brought come into close each other, and a tension adjustor configured to adjust the tensile force generated by the tensile member.

According to this configuration, when a tensile force is generated using the tensile member by the tension adjustor, the pressing members approach each other. Accordingly, since both ends of the acceleration cavity are pressed in the direction of the beam axis of the charged particle beam or in the direction perpendicular to the beam axis, and thereby the acceleration cavity is deformed so as to change the length of a particle passage of charged particles, it is possible to tune the resonance frequency of the acceleration cavity.

A mechanism for tuning the resonance frequency of the acceleration cavity includes the pressing members, the tensile member and the tension adjustor. Therefore, the mechanism has a simple configuration.

Since the tensile member is disposed to be continuous on the outer circumference of the refrigerant tank, the pressing members can be disposed at least at positions at which a size protruding laterally from the acceleration cavity is minimized and the acceleration cavity is pressed. Accordingly, it is possible to prevent a member that tunes the resonance frequency from protruding greatly outward from the acceleration cavity or the refrigerant tank.

According to a second aspect of the invention, in the superconducting accelerator according to the first aspect, the tensile member may be a wire, and a plurality of pulleys on which the wire is put may be positioned at the outer circumference of the refrigerant tank at intervals in a circumferential direction of the refrigerant tank.

According to this configuration, when the wire is drawn by the tension adjustor, the length of a particle passage of the charged particle beam in the acceleration cavity can be adjusted using the pair of pressing members. Since the wire is put on the plurality of pulleys positioned at the outer circumference of the refrigerant tank, the wire can be disposed around the outer circumference of the refrigerant tank without interfering with the refrigerant tank.

According to a third aspect of the invention, in the superconducting accelerator according to the second aspect, a support protrusion portion protruded outward from the outer circumference of the refrigerant tank and configured to support the pulleys in a rotatable manner may be positioned at the outer circumference of the refrigerant tank.

According to this configuration, the pulleys can be positioned outside the refrigerant tank. Accordingly, the wire can be disposed to be continuous around the outer circumference of the refrigerant tank such that the wire does not interfere with the refrigerant tank.

By supporting the pulleys with the support protrusion portion positioned at the outer circumference of the refrigerant tank, it is not necessary to secure the strength for supporting the pulleys using only the refrigerant tank. Accordingly, it is possible to achieve a decrease in thickness of outer panels of the refrigerant tank and to achieve a decrease in the weight and heat capacity of the refrigerant tank.

According to a fourth aspect of the invention, in the superconducting accelerator according to the third aspect, the support protrusion portion may be formed on the outer circumference of the refrigerant tank so as to be continuous in the circumferential direction of the refrigerant tank.

According to this configuration, it is possible to enhance the strength of the support protrusion portion supporting the pulleys. Accordingly, it is possible to further effectively achieve a decrease in weight and heat capacity due to a decrease in thickness of outer panels of the refrigerant tank.

According to a fifth aspect of the invention, in the superconducting accelerator according to any one of the second to fourth aspects, the pressing members may be provided with the pulleys.

According to this configuration, the tensile force of the tensile member is directly applied to the pressing members positioned at pressed positions of the acceleration cavity. Accordingly, it is possible to efficiently press the acceleration cavity with the pressing members. The pressing members can be disposed to abut only the pressed positions of the acceleration cavity, thereby achieving a decrease in size of the pressing members.

According to a sixth aspect of the invention, an superconducting accelerator includes an acceleration cavity in which a space to accelerate a charged particle beam in a superconductive state is formed, a refrigerant tank positioned at an outer circumference of the acceleration cavity, a gap between the refrigerant tank and the acceleration cavity accommodated in the refrigerant tank being filled with a refrigerant for cooling the acceleration cavity. Also, the superconducting accelerator includes a pair of arms provided to an outer circumference of the refrigerant tank so as to be respectively positioned at both side ends of the acceleration cavity in a direction of a beam axis of the charged particle beam or at both ends of the acceleration cavity in a direction perpendicular to the beam axis, the arms being supported in a swingable manner around a support shaft disposed on the outer circumference of the refrigerant tank, and first ends of the arms are disposed so as to face the both ends of the acceleration cavity. The superconducting accelerator further includes an arm displacing device configured to displace second ends of the arms in a direction in which the second ends are separated from each other thereby pressing the both ends of the acceleration cavity with the first ends of the arms.

According to this configuration, when the second ends of the arms are separated from each other by the arm displacing device, the arms swings around the support shaft, and the first ends of the arms press the ends of the acceleration cavity in the beam axis direction of the charged particle beam or the ends of the acceleration cavity in a direction perpendicular to the beam axis direction. Accordingly, since both ends of the acceleration cavity are pressed in the direction of the beam axis of the charged particle beam or in the direction perpendicular to the beam axis, and thereby the acceleration cavity is deformed so as to change the length of a particle passage of charged particles, it is possible to tune the resonance frequency of the acceleration cavity.

A mechanism for tuning the resonance frequency of the acceleration cavity includes the arms, the support shaft and the arm displacing device. Therefore, the mechanism has a simple configuration.

The arms can be disposed at positions at which the acceleration cavity is pressed along the outer circumference of the refrigerant tank, and thus it is possible to prevent a member that tunes the resonance frequency from protruding outward from the acceleration cavity or the refrigerant tank.

According to a seventh aspect of the invention, in the superconducting accelerator according to the sixth aspect, each of the arms may be extending from both ends of the acceleration cavity in the direction of the beam axis of the charged particle beam or from both ends of the acceleration cavity in the direction perpendicular to the beam axis to opposite sides in a circumferential direction of the refrigerant tank.

According to this configuration, the ends of the acceleration cavity in the direction of the beam axis of the acceleration cavity or the ends of the acceleration cavity in the direction perpendicular to the beam axis can be uniformly pressed by the arms disposed on both sides in the circumferential direction of the refrigerant tank.

According to an eighth aspect of the invention, in the superconducting accelerator according to the sixth or seventh aspect, a support protrusion portion protruded outward from the outer circumference of the refrigerant tank and configured to support the support shaft may be positioned at the outer circumference of the refrigerant tank.

According to this configuration, it is possible to achieve a decrease in thickness of outer panels of the refrigerant tank and to secure the strength of the support protrusion portion that supporting the support shaft.

According to a ninth aspect of the invention, in the superconducting accelerator according to the eighth aspect, the support protrusion portion may be formed on the outer circumference of the refrigerant tank so as to be continuous in the circumferential direction of the refrigerant tank.

According to this configuration, it is possible to enhance the strength of the support protrusion portion supporting the pulleys.

Advantageous Effects of Invention

According to the superconducting accelerator, it is possible to satisfactorily tune a resonance frequency of a superconductive acceleration cavity and to achieve a decrease in costs, a decrease in size of the superconducting accelerator, and a decrease in labor for a layout operation.

DESCRIPTION OF EMBODIMENTS

Hereinafter, superconducting accelerators according to embodiments of the invention will be described with reference to the accompanying drawings.

First Embodiment

Figure 1:
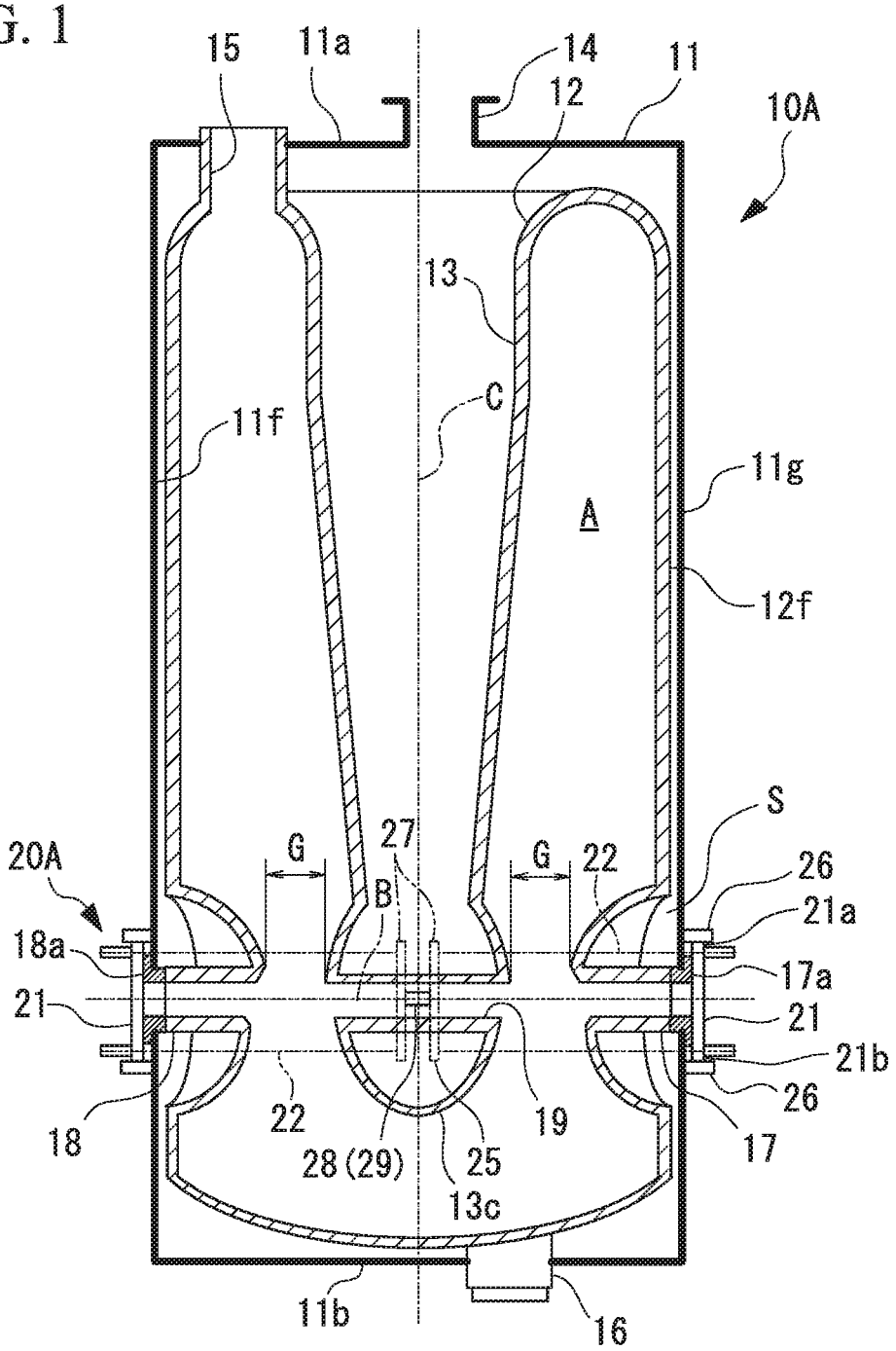
FIG. 1 is a sectional elevation view showing a configuration of a superconducting accelerator according to a first embodiment.
Figure 2:
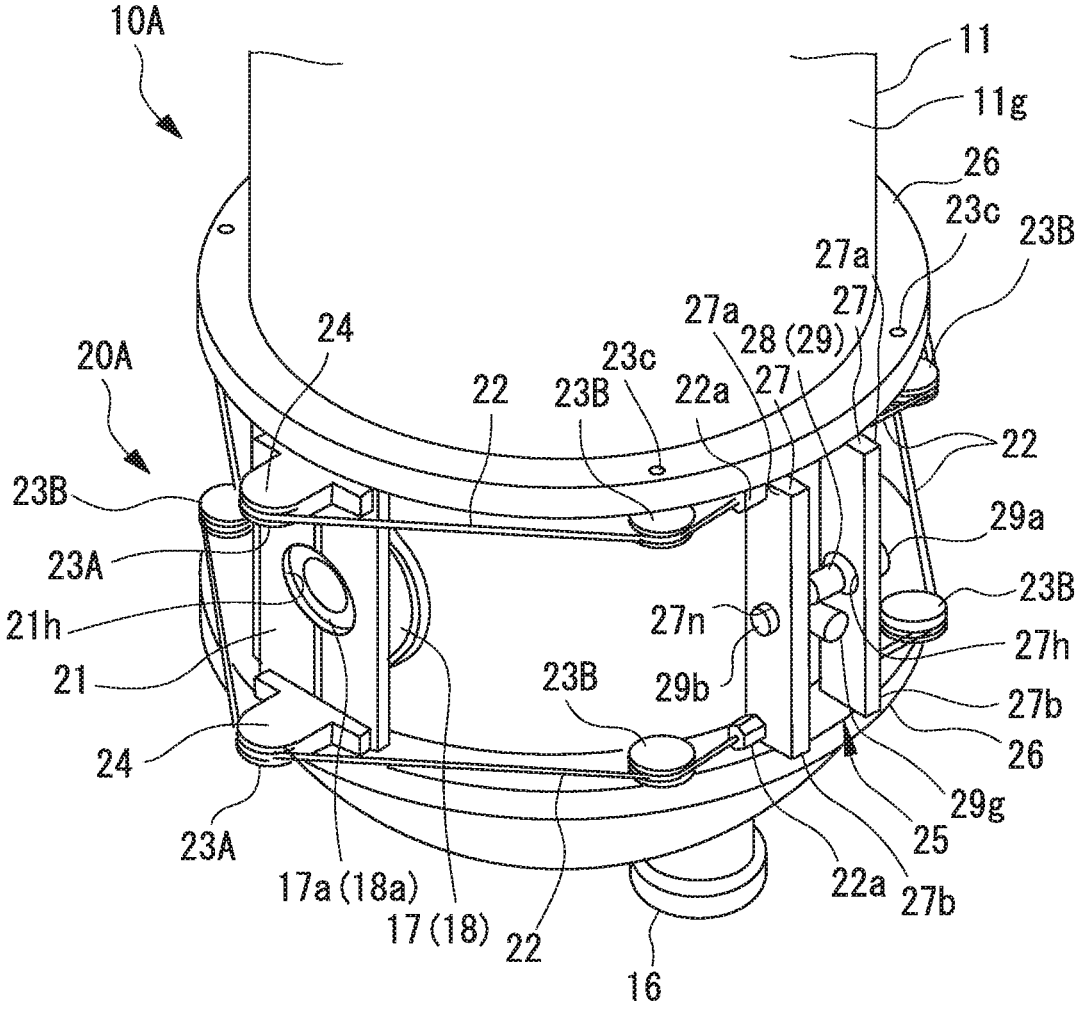
FIG. 2 is a perspective view showing a resonance frequency tuning mechanism with the superconducting accelerator is provided.
Figure 3:
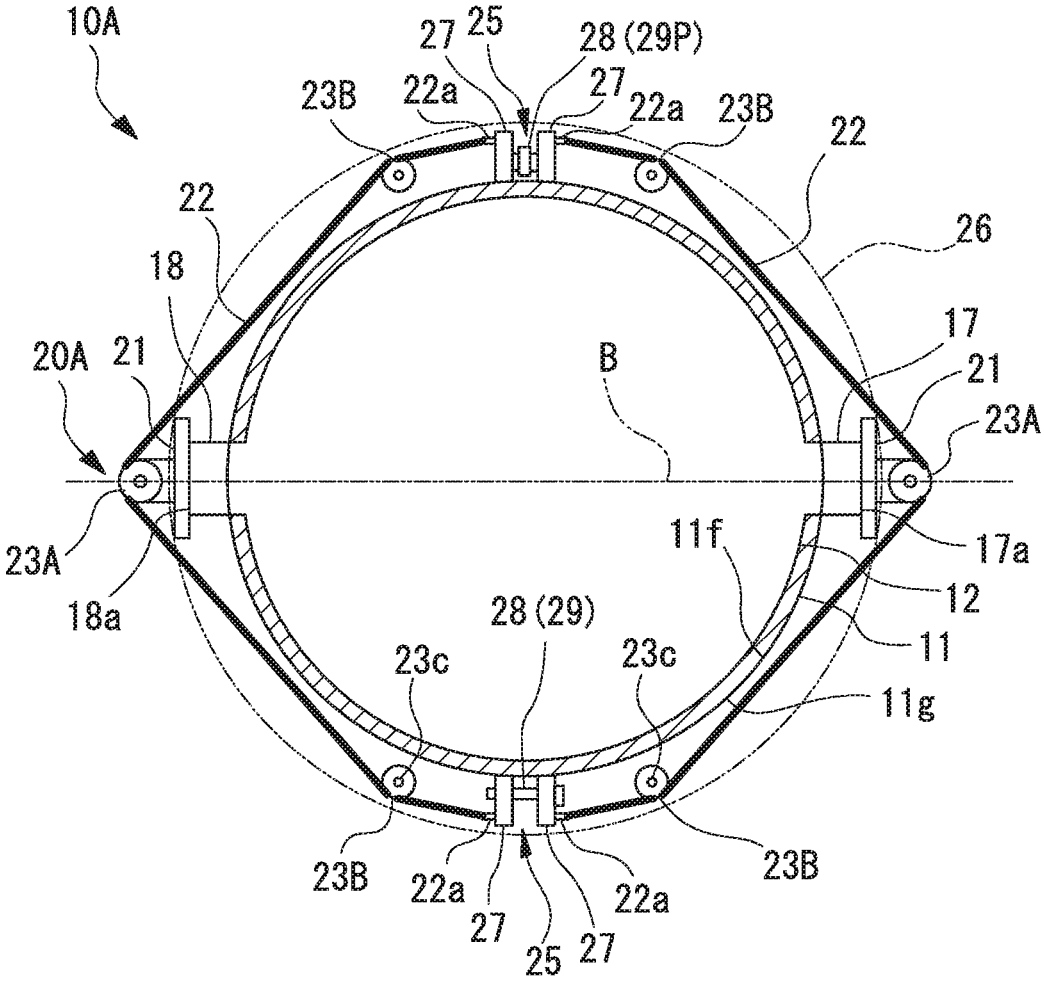
FIG. 3 is a sectional plan view of the resonance frequency tuning mechanism.

FIG. 1 is a sectional elevation view showing a configuration of a superconducting accelerator according to a first embodiment. FIG. 2 is a perspective view showing a resonance frequency tuning mechanism which is provided in the superconducting accelerator. FIG. 3 is a sectional plan view of the resonance frequency tuning mechanism.

As shown in FIG. 1, a superconducting accelerator 10A according to this embodiment is, for example, a coaxial quarter-wave superconducting accelerator (QWR: Quarter Wave Resonator). The superconducting accelerator 10A includes a refrigerant tank 11 and an acceleration cavity 12 in which a space to accelerate a charged particle beam B including charged particles such as electrons or protons, wherein refrigerant is filled with a gap between the refrigerant tank 11 and the acceleration cavity 12.

The refrigerant tank 11 is a columnar vacuum vessel having a center axis C extending in a vertical direction, and a top surface 11*a* and a bottom surface 11*b* thereof are closed. The refrigerant tank 11 may include a shield layer that reduces the influence of geomagnetism or radiant heat from the outside.

The acceleration cavity 12 is formed of a superconducting material such as niobium and has a hollow chamber shape which extends in the vertical direction. A gap S is formed between the acceleration cavity 12 and an inner circumferential surface 11*f* of the refrigerant tank 11.

The acceleration cavity 12 includes a beam input port 17 and a beam output port 18 which have a circular cross-section on a lower side of an outer conductor surface 12*f*. The beam input port 17 and the beam output port 18 are disposed at opposite positions to each other in a diameter direction of the 12 perpendicular to a center axis C of the refrigerant tank 11. The beam input port 17 and the beam output port 18 extend outward in a radial direction from the outer conductor surface 12*f* of the acceleration cavity 12 and pass through the refrigerant tank 11, thereby protruding outward in the radial direction of the refrigerant tank 11.

The acceleration cavity 12 includes a stem 13 which is formed to extend in the vertical direction along the center axis C of the refrigerant tank 11. The stem 13 is recessed downward from a top end of the acceleration cavity 12 and an inner diameter thereof decreases gradually from up to down. A drift tube 13*c* which is formed in a ring shape continuously from the stem 13 is integrally formed in a lower end portion of the stem 13. Inside the drift tube 13*c*, a beam flow tube portion 19 is formed coaxially with the beam input port 17 and the beam output port 18 of the acceleration cavity 12.

A cleaning port 15 that passes through a top surface 11*a* of the refrigerant tank 11 and communicates with the inside of the hollow acceleration cavity 12 is disposed at the top end of the acceleration cavity 12. By producing a vacuum through the cleaning port 15 using a vacuum pump or the like, the inside of the acceleration cavity 12 can be made to enter a vacuum state.

The acceleration cavity 12 includes an input coupler port 16 at the bottom thereof. By inputting high-frequency power from the input coupler port 16, an electric field that accelerates a charged particle beam B is generated in a space A in the acceleration cavity 12.

As shown in FIG. 1, the refrigerant tank 11 includes a refrigerant supply port 14 that is formed in the top surface 11*a* and supplies a refrigerant into the refrigerant tank 11. The refrigerant fed from the refrigerant supply port 14 flows to a gap S between the inner circumferential surface 11*f* of the refrigerant tank 11 and the outer conductor surface 12*f* of the acceleration cavity 12, the stem 13, and the ring-shaped passage 12*c*. Here, liquid helium or the like can be used as the refrigerant.

In the superconducting accelerator 10A, the acceleration cavity 12 is cooled by the refrigerant fed into the refrigerant tank 11 and becomes a superconductive state. The charged particle beam B is input to the acceleration cavity 12 from the beam input port 17 disposed on a first side in the diameter direction of the acceleration cavity 12, passes through the beam flow tube portion 19 formed inside the drift tube 13*c* disposed at the bottom of the stem 13, and is output from the beam output port 18 disposed on a second side in the diameter direction of the acceleration cavity 12 to the outside of the acceleration cavity 12.

A plurality of superconducting accelerators, each of which is identical to the above-mentioned superconducting accelerator 10A, are continuously connected along a particle passage of the charged particle beam B. In the neighboring superconducting accelerators 10A, the beam input port 17 formed in the acceleration cavity 12 of one superconducting accelerator 10A is connected to the beam output port 18 formed in the acceleration cavity 12 of the other superconducting accelerator 10A via a connection tube (not shown) or the like.

As shown in FIGS. 1 and 2, flange portions 26 are formed on the outer circumferential surface 11*g* of the refrigerant tank 11. The flange portions 26 are formed above and below of a flange 17*a* of the beam input port 17 and a flange 18*a* of the beam output port 18. The flange portions 26 are formed to protrude outward in the radial direction from the outer circumferential surface 11*g* of the refrigerant tank 11. In this embodiment, the flange portions 26 are formed in a ring shape which extends continuously in a circumferential direction along the outer circumferential surface 11*g* of the refrigerant tank 11.

Each superconducting accelerator 10A includes a resonance frequency tuning mechanism 20A. The resonance frequency tuning mechanism 20A tunes a resonance frequency of the acceleration cavity 12 by adjusting a gap between the flange 17*a* of the beam input port 17 and the flange 18*a* of the beam output port 18, particularly, a beam acceleration gap G.

As shown in FIGS. 2 and 3, the resonance frequency tuning mechanism 20A includes pressing members 21, wires (tensile members) 22, pulleys 23A and 23B, and tension adjustors 25.

The pressing members 21 are provided to the outer circumference of the refrigerant tank 11 so as to be respectively disposed at opposite positions to each other in the diameter direction of the refrigerant tank 11. In other words, the pressing members 21 are disposed at positions which are symmetric with respect to the refrigerant tank 11 with two members as a pair. In this embodiment, the pressing members 21 are located between the two upper and lower flange portions (support protrusion portions) 26, and are in contact with the flange 17*a* of the beam input port 17 and the flange 18*a* of the beam output port 18, respectively.

Each of the pressing members 21 is formed in a rectangular plate shape, has an aperture 21*h* communicating with the beam input port 17 or the beam output port 18, which is formed at the center thereof, and is divided into two halves in the circumferential direction of the refrigerant tank 11 with respect to the aperture 21*h*.

In the pressing members 21, a height in the direction of the center axis C of the refrigerant tank 11 is larger than an outer diameter of the beam input port 17 and the beam output port 18. Accordingly, the top end 21*a* and the bottom end 21*b* of the pressing member 21 expand vertically from the beam input port 17 or the beam output port 18. In the pressing members 21, a width in a direction perpendicular to a traveling direction of the charged particle beam B and perpendicular to the center axis C of the refrigerant tank 11 is smaller than the height.

The wires 22 are provided so as to be continuously wound around the outer circumference of the refrigerant tank 11 in the circumferential direction thereof. The wires 22 are disposed between the upper and lower flange portions 26 with two wires as a pair with a gap vertically in the direction of the center axis C of the refrigerant tank 11. One wire 22 is disposed above the flange 17*a* of the beam input port 17 and the flange 18*a* of the beam output port 18, and the other wire 22 is disposed below the flange 17*a* of the beam input port 17 and the flange 18*a* of the beam output port 18. The two wires 22 are put on a plurality of pulleys 23A and 23B so as to be wound around the outer circumference of the refrigerant tank 11 and are disposed to be led continuously in almost half a circumference in the circumferential direction of the refrigerant tank 11.

A plurality of pulleys 23A and 23B are arranged at intervals in the circumferential direction on the outer circumference of the refrigerant tank 11. The pulleys 23A and 23B are disposed above and below the flange 17*a* of the beam input port 17 and the flange 18*a* of the beam output port 18.

The pulleys 23A are supported by brackets 24 which are disposed at upper ends and lower ends of the pressing members 21 in a rotatable manner about axes parallel to the center axis C of the refrigerant tank 11. The brackets 24 are formed to protrude outward in the radial direction of the refrigerant tank 11 from the pressing members 21.

The pulleys 23B are disposed between the pulley 23A disposed on the first side in the diameter direction of the refrigerant tank 11 and the pulley 23A disposed on the second side in the circumferential direction of the refrigerant tank 11. In this embodiment, two pulleys 23B are disposed between the pulley 23A disposed on the first side in the diameter direction of the refrigerant tank 11 and the pulley 23A disposed on the second side with an interval in the circumferential direction of the refrigerant tank 11.

The pulleys 23B are disposed below the upper flange portion 26 or above the lower flange portion 26. Each pulley 23B is disposed in a rotatable manner about a shaft 23*c* which is disposed in the flange portions 26 to be parallel to the center axis C of the refrigerant tank 11.

The tension adjustors 25 include a pair of wire holding plates 27 that are disposed to face each other with a gap in the circumferential direction of the refrigerant tank 11 and a gap adjusting member 28 that adjusts the gap between the wire holding plates 27.

Wire fixing points 22*a* of the upper and lower wires 22 are fixed to an upper end 27*a* and a lower end 27*b* of each wire holding plate 27.

For example, a screw 29 can be used as the gap adjusting member 28. A portion close to a head portion 29*a* of the screw 29 is inserted into a screw insertion hole 27*h* formed in one wire holding plate 27 and a shaft portion 29*b* on which a male threaded portion is formed is screwed into a hole 27*n*. By rotating the screw 29 about an axis using a worm gear 29*g* disposed in a drive shaft of a motor which is not shown, the wire holding plates 27 are brought into close to each other or are separated from each other. The tensile force applied to the upper and lower wires 22 is adjusted by bringing the wire holding plates 27 closer together or farther apart.

As shown in FIG. 3, a piezoelectric element 29P such as a piezo element can be used as the gap adjusting member 28. In this embodiment, the tension adjustors 25 are disposed on opposite sides in the diameter direction of the refrigerant tank 11, a screw 29 is used as the gap adjusting member 28 of one tension adjustor 25, and the piezoelectric element 29P is used as the gap adjusting member 28 of the other tension adjustor 25. Accordingly, coarse adjustment of the tensile force of the wires 22 can be performed by rotating the screw 29 as the gap adjusting member 28 of one tension adjustor 25, and fine adjustment of the tensile force of the wires 22 can be performed by driving the piezoelectric element as the gap adjusting member 28 of the other tension adjustor 25.

With this configuration, when the tensile force applied to the wires 22 are increased by adjusting the gap between the wire holding plates 27 using the tension adjustors 25, the tensile force of the wires 22 is delivered to the pressing members 21 via the pulleys 23A. Specifically, when the gap between the two wire holding plates 27 is decreased, the pressing members 21 are brought into close to each other in the diameter direction of the refrigerant tank 11 by the tensile force of the wires 22, and the flange 17*a* of the beam input port 17 and the flange 18*a* of the beam output port 18 can be pressed in the particle passage direction of the charged particle beam B. When the gap between the wire holding plates 27 is increased in a state in which the wires 22 supply the tensile force, the tensile force of the wire 22 is decreased and the pressing members 21 are separated from each other, and a force for pressing the flange 17*a* of the beam input port 17 and the flange 18*a* of the beam output port 18 in the particle passage direction of the charged particle beam B is decreased. In this way, it is possible to adjust the gap between the flange 17*a* of the beam input port 17 and the flange 18*a* of the beam output port 18, particularly, the beam acceleration gap G.

In addition to the above-mentioned configuration, a safety countermeasure such as a protective cover may be provided around the resonance frequency tuning mechanism 20A.

Accordingly, with the superconducting accelerator 10A according to the first embodiment, when a tensile force is generated by the wires 22, the pressing members 21 approach each other. Accordingly, since the opposite ends of the acceleration cavity 12 in the particle passage direction of the charged particle beam B are pressed and the acceleration cavity 12 is deformed to change the length of the particle passage of charged particle beam B, it is possible to tune the resonance frequency of the acceleration cavity 12.

A mechanism for tuning the resonance frequency of the acceleration cavity 12 includes the pressing members 21, the wires 22, and the tension adjustors 25 and thus has a simple configuration.

Since the wires 22 are disposed to be continuous on the outer circumference of the refrigerant tank 11, the pressing members 21 can be disposed at least at the flange 17*a* of the beam input port 17 and the flange 18*a* of the beam output port 18 which are positions at which a size protruding laterally from the acceleration cavity 12 is minimized and the acceleration cavity 12 is pressed. Accordingly, it is possible to prevent the member that tunes the resonance frequency from protruding greatly outward from the acceleration cavity 12 or the refrigerant tank 11.

The superconducting accelerator 10 can satisfactorily tune the resonance frequency of the acceleration cavity 12 and achieve a decrease in costs, a decrease in size of the superconducting accelerator, and a decrease in labor for a layout operation.

When the wires 22 are drawn by the tension adjustors 25, the length of the particle passage of the charged particle beam B in the acceleration cavity 12 can be adjusted using the pair of pressing members 21 and the resonance frequency can be easily and satisfactorily tuned.

The flange portions 26 that rotatably support the pulleys 23B are disposed on the outer circumference of the refrigerant tank 11. By employing this configuration, the wires 22 can be disposed to be continuous on the outer circumference of the refrigerant tank 11 without interfering with the refrigerant tank 11.

By supporting the pulleys 23A and 23B with the flange portions 26 disposed on the outer circumference of the refrigerant tank 11, it is not necessary to secure the strength for supporting the pulleys 23A and 23B using only the refrigerant tank 11. Accordingly, it is possible to achieve a decrease in thickness of the refrigerant tank 11 and to achieve a decrease in weight and a decrease in the heat capacity of the refrigerant tank 11.

The flange portions 26 are formed to be continuous in the circumferential direction along the outer circumference of the refrigerant tank 11. By forming the flange portions 26 in a ring shape this way, it is possible to enhance the strength of the flange portions 26 that is configured to support the pulleys 23A and 23B and to effectively reinforce the refrigerant tank 11.

The pulleys 23A and 23B are provided in the pressing members 21. By employing this configuration, the tensile force of the wires 22 is directly applied to the pressing members 21 disposed at pressed positions of the acceleration cavity 12 via the pulleys 23A and 23B. Accordingly, it is possible to efficiently press the acceleration cavity 12 with the pressing members 21.

Modified Examples of First Embodiment

In the first embodiment, the upper and lower wires 22 are fixed to the upper end 27*a* and the lower end 27*b* of the wire holding plates 27, but the invention is not limited thereto.

First Modified Example

Figure 4:
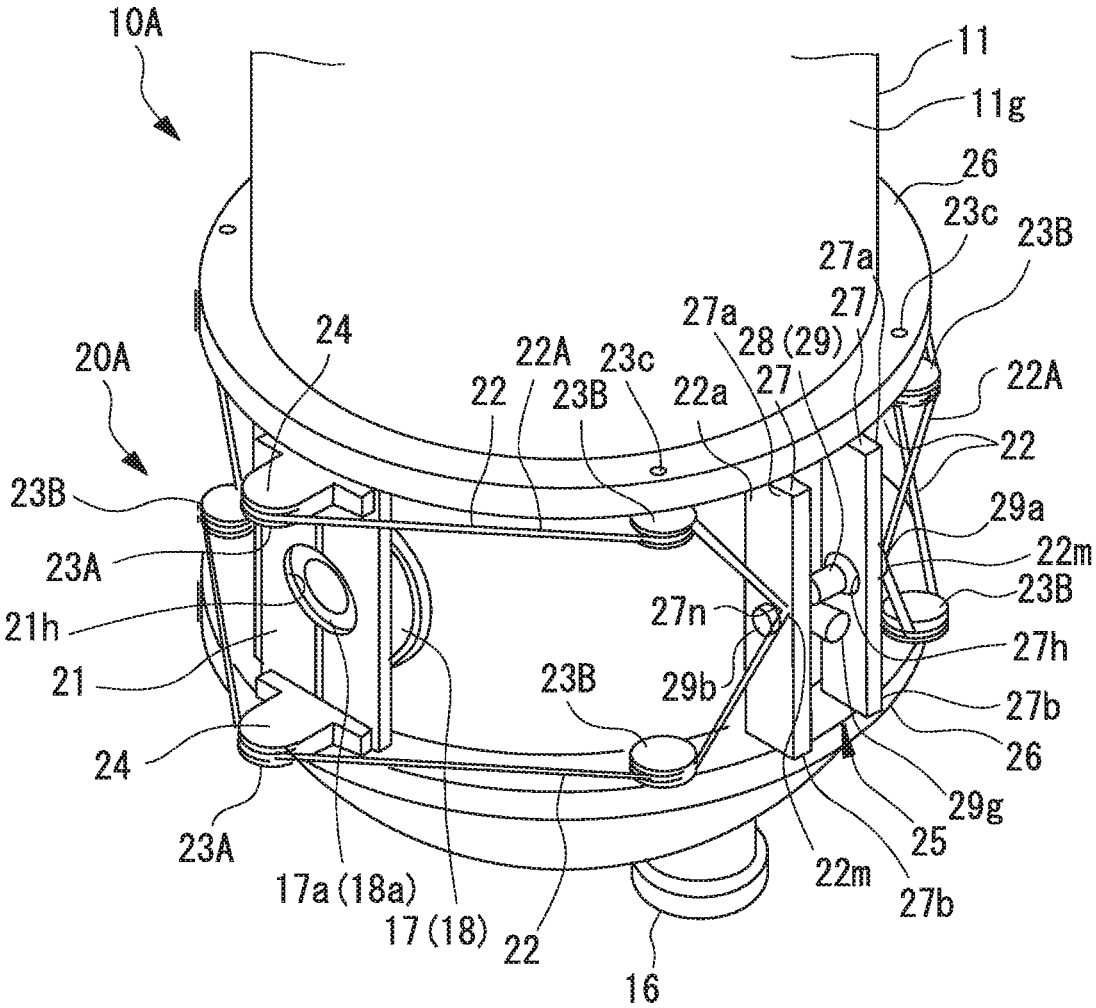
FIG. 4 is a perspective view showing a resonance frequency tuning mechanism in a first modified example of the first embodiment of the superconducting accelerator.

FIG. 4 is a perspective view showing a resonance frequency tuning mechanism in a first modified example of the first embodiment of the superconducting accelerator.

As shown in FIG. 4, the upper and lower wires 22 may be replaced with a single continuous wire 22A. In that case, an intermediate portion 22*m* of the wire 22A may be fixed to the wire holding plates 27 or may be put on a pulley (not shown). By employing this configuration, it is possible to uniformly apply a tensile force to the upper and lower wires 22.

Second Modified Example

In the first embodiment, one screw 29 or a piezoelectric element (not shown) is used as the gap adjusting member 28 that adjusts a gap between the wire holding plates 27, but the invention is not limited thereto.

Figure 5:
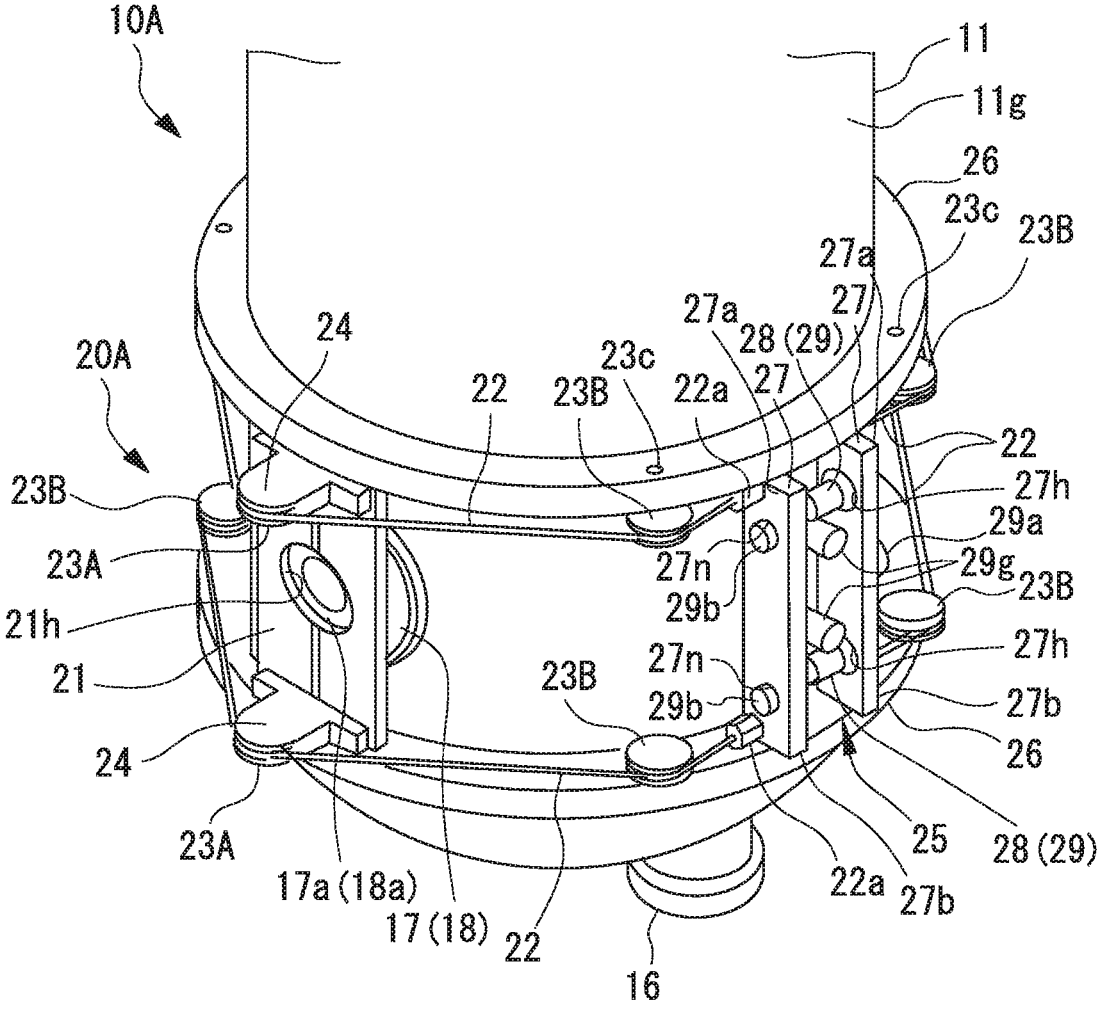
FIG. 5 is a perspective view showing a resonance frequency tuning mechanism in a second modified example of the first embodiment of the superconducting accelerator.

FIG. 5 is a perspective view showing a resonance frequency tuning mechanism in a second modified example of the first embodiment of the superconducting accelerator.

As shown in FIG. 5, as the gap adjusting member 28 that adjusts the gap between the wire holding plates 27, a plurality of (for example, two) bolts 29 or piezoelectric elements (not shown) may be disposed with an interval in the vertical direction. Accordingly, it is possible to more safely adjust the gap between the wire holding plates 27. By adjusting the gap between the wire holding plates 27 to be different between the upper and lower wires, the tensile forces applied to the upper and lower wires 22 may be independently adjusted.

Second Embodiment

A superconducting accelerator according to a second embodiment of the invention will be described below. The second embodiment is different from the first embodiment in only the configuration of a resonance frequency tuning mechanism 20B, and both embodiments share the configuration of the superconducting accelerator 10A. Accordingly, the same elements as in the first embodiment will be provided with the same reference signs and description thereof will not be repeated.

Figure 6:
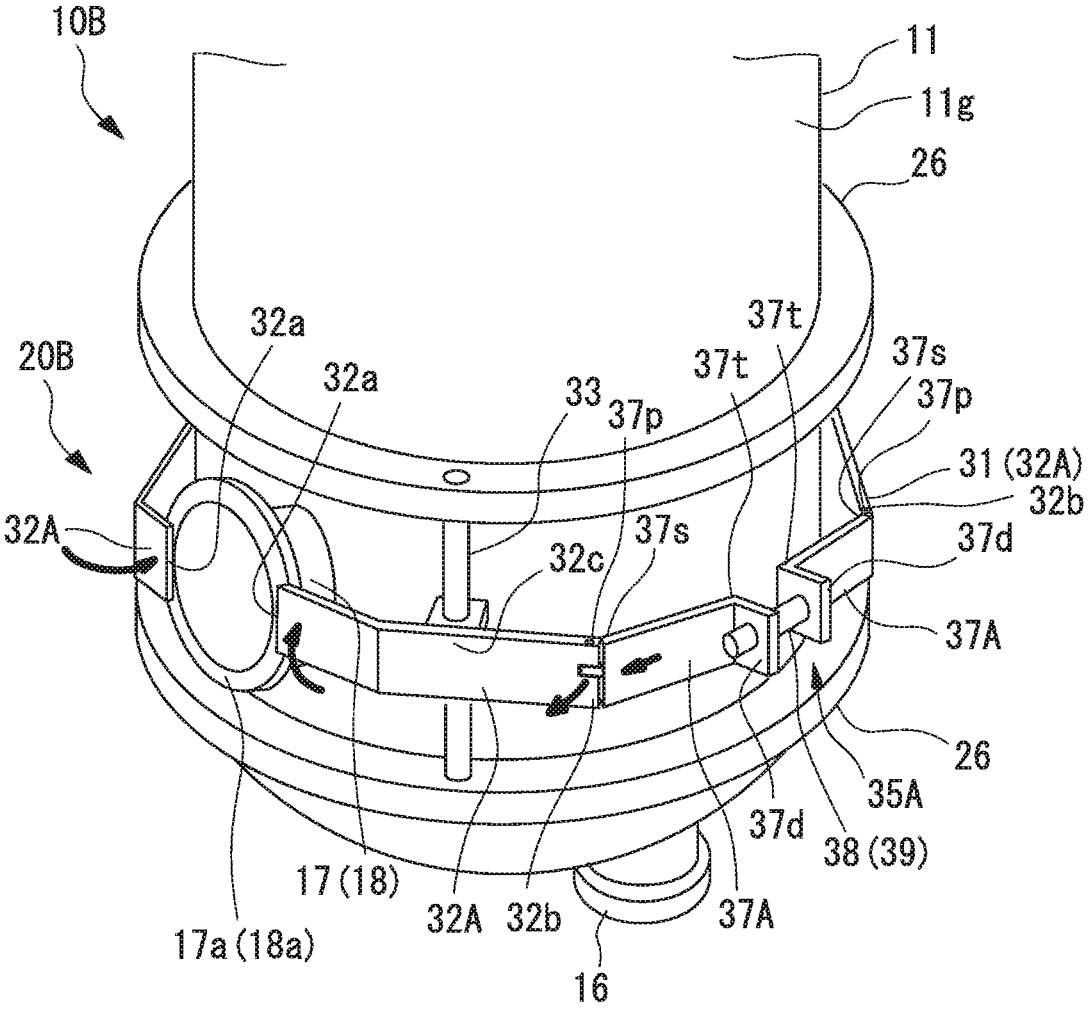
FIG. 6 is a perspective view showing a resonance frequency tuning mechanism which is provided in a superconducting accelerator according to a second embodiment.
Figure 7:
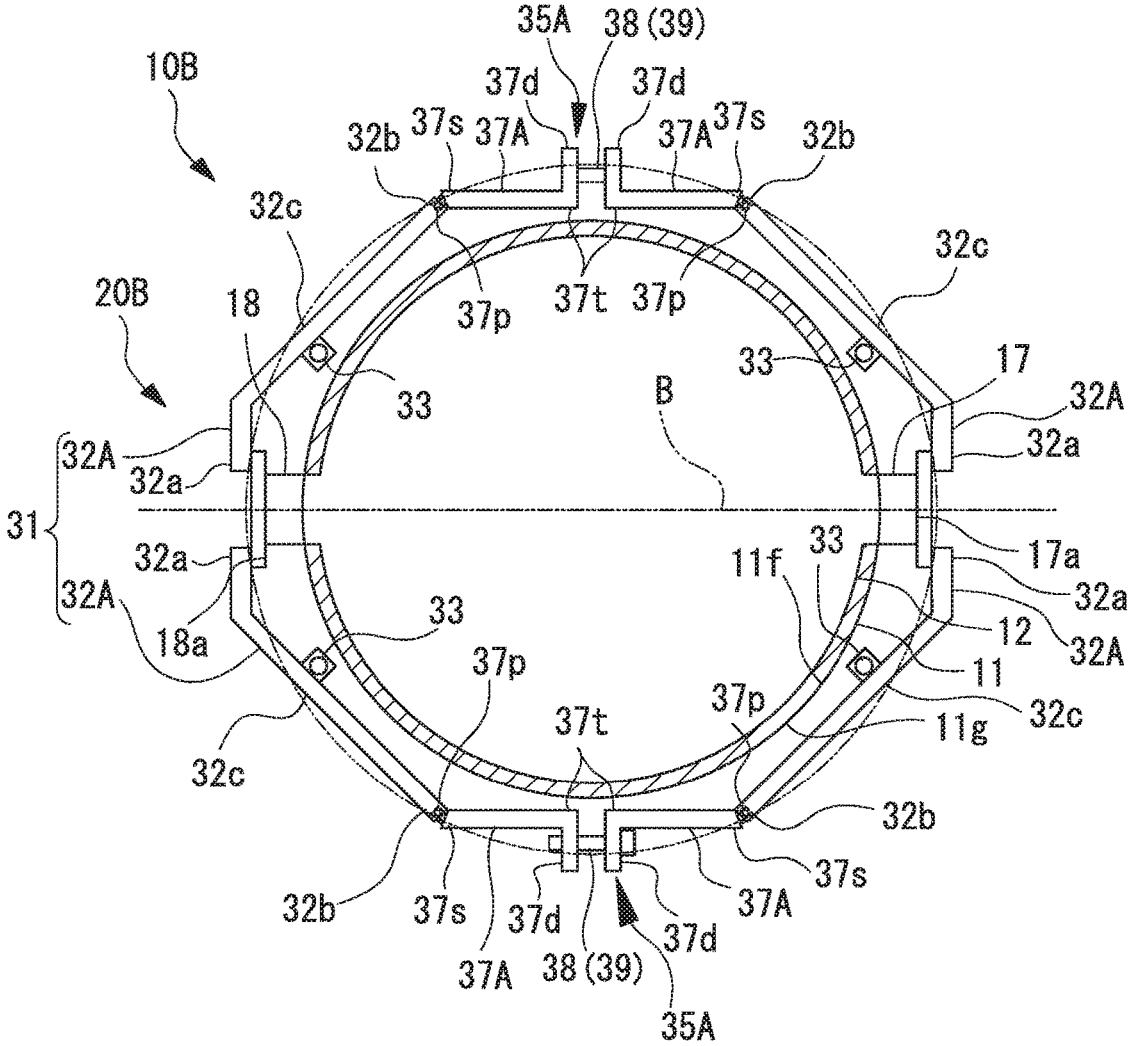
FIG. 7 is a sectional plan view of the resonance frequency tuning mechanism.

FIG. 6 is a perspective view showing a resonance frequency tuning mechanism which is provided in the superconducting accelerator according to the second embodiment. FIG. 7 is a sectional plan view of the resonance frequency tuning mechanism.

As shown in FIG. 6, the superconducting accelerator 10B according to this embodiment includes flange portions 26 that protrude outward in the radial direction from the outer circumferential surface 11*g* of the refrigerant tank 11 above and below the flange 17*a* of the beam input port 17 and the flange 18*a* of the beam output port 18.

As shown in FIGS. 6 and 7, the superconducting accelerator 10B includes a resonance frequency tuning mechanism 20B. The resonance frequency tuning mechanism 20B tunes the resonance frequency of the acceleration cavity 12 by adjusting the gap between the flange 17*a* of the beam input port 17 and the flange 18*a* of the beam output port 18, particularly, the beam acceleration gap G (refer to FIG. 1).

The resonance frequency tuning mechanism 20B includes pressing members 31 and arm displacing devices 35A.

The pressing members 31 are provided to the outer circumference of the refrigerant tank 11 so as to be respectively disposed at opposite positions to each other in the diameter direction of the refrigerant tank 11. The pressing members 31 include arms 32A disposed on opposite sides in the circumferential direction of the refrigerant tank 11 between the upper and lower flange portions 26 for each of the flange 17*a* of the beam input port 17 and the flange 18*a* of the beam output port 18.

Each arm 32A extends continuously along the outer circumferential surface 11*g* in the circumferential direction of the refrigerant tank 11, and an intermediate portion 32*c* between a first end 32*a* and a second end 32*b* is disposed in a swingable manner about a shaft (a support shaft) 33 disposed between the upper and lower flange portions 26.

The first end 32*a* of the arm 32A contacts with the flange 17*a* of the beam input port 17 or the flange 18*a* of the beam output port 18 such that they overlap in an axial direction of the beam input port 17 or the beam output port 18.

The arm displacing devices 35A includes push arms 37A and a gap adjusting member 38 that adjusts the gap between the push arm 37A on the beam input port 17 side and the push arm 37A on the beam output port 18 side.

A first end 37*s* of the push arm 37A is connected to a second end 32*b* of the arm 32A via a pin 37*p* in a rotatable manner about an axis parallel to the center axis C (refer to FIG. 1) of the refrigerant tank 11. A bracket portion 37*d* that protrudes outward in the radial direction of the refrigerant tank 11 from the outer circumferential surface 11*g* of the refrigerant tank 11 is formed at a second end 37*t* of the push arm 37A. The bracket portions 37*d* of the push arm 37A on the beam input port 17 side and the push arm 37A on the beam output port 18 side face each other with a gap between the circumferential direction of the refrigerant tank 11.

For example, a screw 39 can be used as the gap adjusting member 38. By rotating the screw 39 about an axis, the bracket portion 37*d* of the push arm 37A on the beam input port 17 side and the bracket portion 37*d* of the push arm 37A on the beam output port 18 side approach each other and are separated from each other.

Here, in the flange 17*a* of the beam input port 17 and the flange 18*a* of the beam output port 18, motions of the arms 32A located on opposite sides in the circumferential direction are generally synchronized with each other. For this purpose, the motions of the bolts 39 which are the gap adjusting members 38 disposed on the opposite sides in the diameter direction of the refrigerant tank 11 are synchronized with each other.

When the bracket portions 37*d* of the push arms 37A are brought into close to or are separated from each other by the gap adjusting members 38, the push arms 37A on the beam input port 17 side and the beam output port 18 side slide in a tangent direction of the outer circumferential surface 11*g* of the refrigerant tank 11. Accordingly, the first ends 37*s* of the push arms 37A displaces the second ends 32*b* of the arms 32A, and the arms 32A swing about the shafts 33.

Specifically, when the bracket portions 37*d* of the push arms 37A are separated from each other, the second ends 32*b* of the arms 32A are pressed to the first ends 37*s* of the push arms 37A. Then, the arms 32A swing about the shafts 33, the first ends 32*a* are displaced in a direction in which the first ends approach the outer circumferential surface 11*g* of the refrigerant tank 11, and thus the first ends 32*a* press the flange 17*a* of the beam input port 17 and the flange 18*a* of the beam output port 18 in the particle passage direction of the charged particle beam B.

When the bracket portions 37*d* of the push arms 37A are brought into close to each other by the gap adjusting member 38, the second end 32*b* of each arm 32A is drawn to the first end 37*s* of the push arm 37A. Then, the arm 32A swings about the shaft 33, the first end 32*a* is displayed in which the first end is separated from the outer circumferential surface 11*g* of the refrigerant tank 11, and a force for pressing the flange 17*a* of the beam input port 17 and the flange 18*a* of the beam output port 18 in the particle passage direction of the charged particle beam B is decreased.

In this way, it is possible to adjust the gap between the flange 17*a* of the beam input port 17 and the flange 18*a* of the beam output port 18, particularly, the beam acceleration gap G.

Here, as the gap adjusting member 38, a piezoelectric element such as a piezo element which is coaxial with the screw 39 can be used. Accordingly, coarse adjustment of the arms 32A can be performed by rotating the screw 39 and fine adjustment of the arms 32A can be performed by driving the piezoelectric element.

In addition to the above-mentioned configuration, similarly to the first embodiment, a safety countermeasure such as a protective cover may be provided around the resonance frequency tuning mechanism 20B.

Accordingly, in the superconducting accelerator 10B according to the second embodiment, when the push arms 37A are separated from each other by the arm displacing device 35A, each arm 32A swings about the shaft 33. Accordingly, the flange 17*a* of the beam input port 17 and the flange 18*a* of the beam output port 18 which are ends in the particle passage direction of the charged particle beam B in the acceleration cavity 12 are pressed by the first ends 32*a* of the arms 32A. Then, since the acceleration cavity 12 is deformed to change the length of the particle passage of charged particles, it is possible to adjust the resonance frequency of the acceleration cavity 12.

The mechanism for tuning the resonance frequency of the acceleration cavity 12 includes the arms 32A, the shafts 33, and the arm displacing devices 35A and thus has a simple configuration.

The arms 32A can be disposed at positions at which the acceleration cavity 12 is pressed along the outer circumference of the refrigerant tank 11, and thus it is possible to prevent the member that tunes the resonance frequency from protruding outward from the acceleration cavity 12 or the refrigerant tank 11. The superconducting accelerator 10 can satisfactorily tune the resonance frequency of the acceleration cavity 12 and achieve a decrease in costs, a decrease in size of the superconducting accelerator, and a decrease in labor for a layout operation.

The arms 32A are disposed on opposite sides of the flange 17*a* of the beam input port 17 and the flange 18*a* of the beam output port 18, which are opposite ends in the particle passage direction of the charged particle beam B in the acceleration cavity 12, in the circumferential direction of the refrigerant tank 11. By employing this configuration, it is possible to uniformly press the flange 17*a* of the beam input port 17 and the flange 18*a* of the beam output port 18 using the arms 32A disposed on the opposite sides in the circumferential direction.

The flange portions 26 that support the shafts 33 are disposed on the outer circumference of the refrigerant tank 11. Accordingly, it is possible to achieve a decrease in thickness of the refrigerant tank 11 and to secure the strength of the flange portions 26 that is configured to support the shafts 33.

First Modified Example of Second Embodiment

In the second embodiment, the first ends 37*s* of the push arms 37A are rotatably connected to the second ends 32*b* of the arms 32A via the pins 37*p*, but the invention is not limited thereto.

Figure 8:
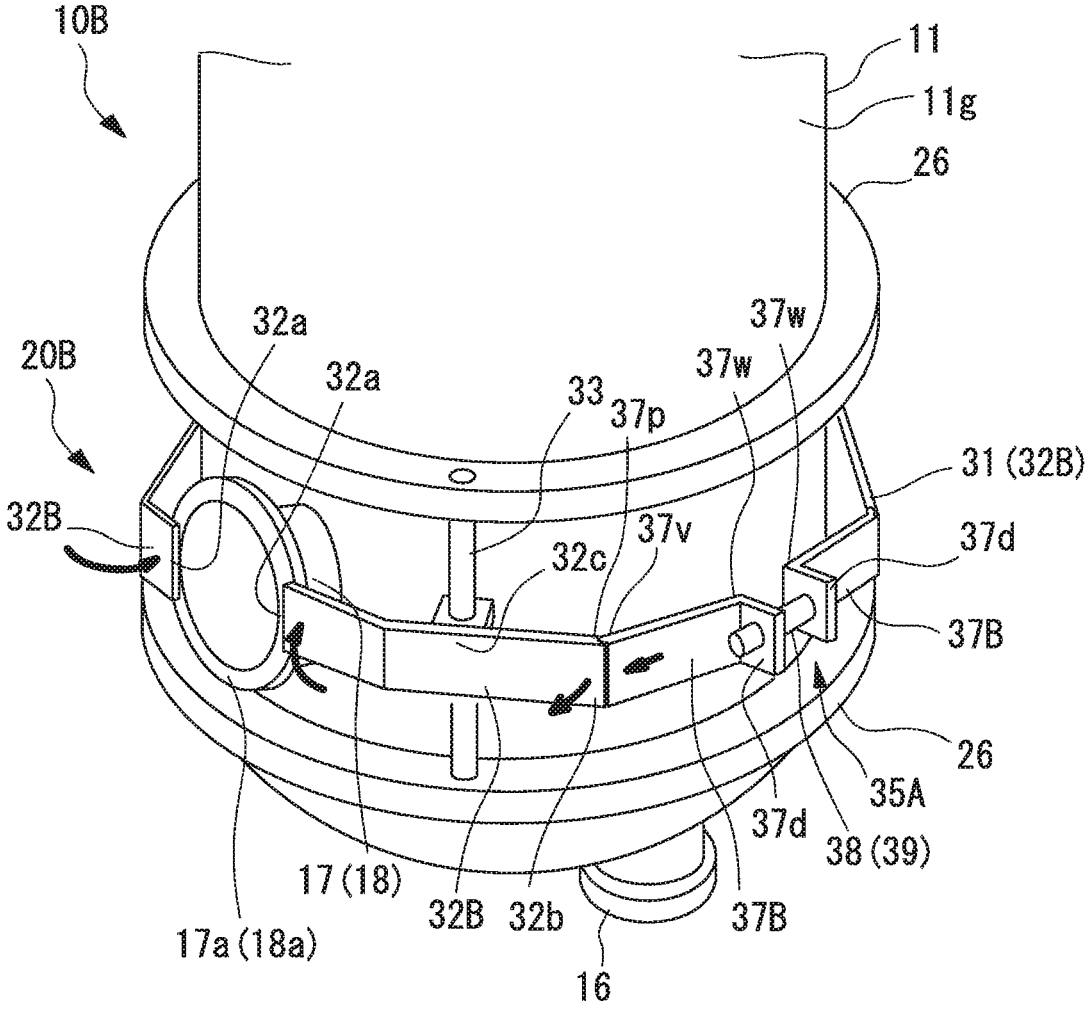
FIG. 8 is a perspective view showing a resonance frequency tuning mechanism in a first modified example of the second embodiment of the superconducting accelerator.

FIG. 8 is a perspective view showing a resonance frequency tuning mechanism in a first modified example of the second embodiment of the superconducting accelerator.

As shown in FIG. 8, arms 32B constituting the pressing members 31 of a resonance frequency tuning mechanism 20B in a first modified example of the second embodiment extend to be continuous in the circumferential direction along the outer circumferential surface 11*g* of the refrigerant tank 11. An intermediate portion 32*c* between a first end 32*a* and a second end 32*b* of each arm 32B is disposed in a swingable manner about a shaft 33 disposed between the upper and lower flange portions 26.

In the modified example, the second end 32*b* of each arm 32B has a concave surface having an arc shape in a plan view.

Each arm displacing device 35A includes push arms 37B and a gap adjusting member 38 that adjusts a gap between the push arm 37B on the beam input port 17 side and the push arm 37B on the beam output port 18 side.

A first end 37*v* of each push arm 37B has a convex surface having an arc shape in a plan view and can slide on the concave surface of the second end 32*b* of the arm 32B. A bracket portion 37*d* that protrudes outward in the radial direction of the refrigerant tank 11 from the outer circumferential surface 11*g* of the refrigerant tank 11 is formed in the second end 37*w* of each push arm 37B.

When the bracket portions 37*d* of the push arms 37B are separated from each other by the gap adjusting member 38, the second end 32*b* of each arm 32B is pressed by the first end 37*v* of the push arm 37B and is displaced. Then, the second end 32*b* of each arm 32B swings about the shaft 33 while sliding on the first end 37*v*, and the first end 32*a* is displaced in a direction in which the first end approaches the outer circumferential surface 11*g* of the refrigerant tank 11. Accordingly, the first ends 32*a* press the flange 17*a* of the beam input port 17 and the flange 18*a* of the beam output port 18 in the particle passage direction of the charged particle beam B.

In this way, it is possible to adjust the gap between the flange 17*a* of the beam input port 17 and the flange 18*a* of the beam output port 18, particularly, the beam acceleration gap G.

Second Modified Example of Second Embodiment

In the second embodiment and the first modified example thereof, the arms 32A and 32B are rotated by the push arms 37A and 38B, but the invention is not limited thereto.

Figure 9:
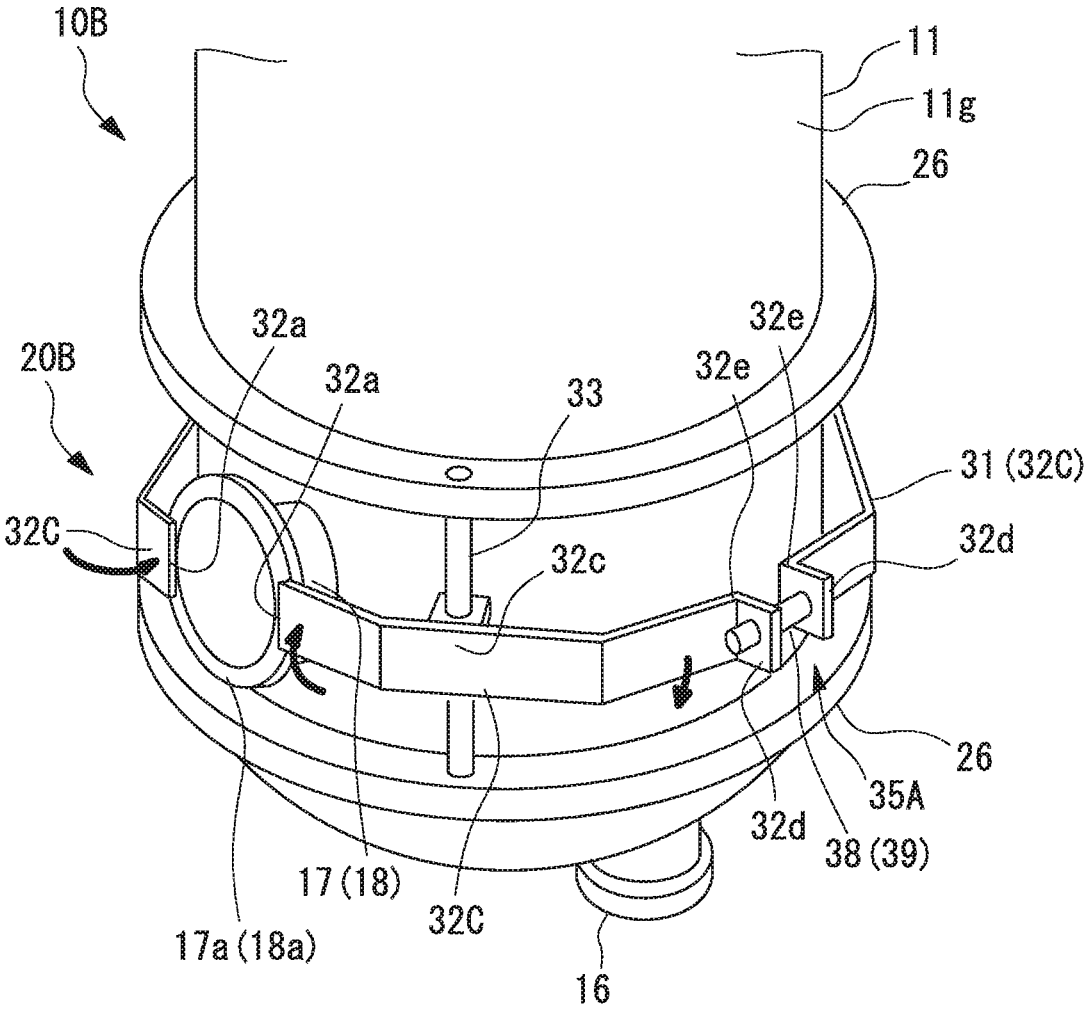
FIG. 9 is a perspective view showing a resonance frequency tuning mechanism in a second modified example of the second embodiment of the superconducting accelerator.

FIG. 9 is a perspective view showing a resonance frequency tuning mechanism in a second modified example of the second embodiment of the superconducting accelerator.

As shown in FIG. 9, a resonance frequency tuning mechanism 20B according to the second modified example of the second embodiment includes pressing members 31 and arm displacing devices 35A.

Arms 32C constituting the pressing members 31 of the resonance frequency tuning mechanism 20B extend to be continuous in the circumferential direction of the refrigerant tank 11 along the outer circumferential surface 11*g*, and an intermediate portion 32*c* between a first end 32*a* and a second end 32*e* is disposed in a swingable manner about a shaft 33 disposed between the upper and lower flange portions 26.

The first end 32*a* of the arm 32C contacts with the flange 17*a* of the beam input port 17 or the flange 18*a* of the beam output port 18 such that they overlap in an axial direction of the beam input port 17 or the beam output port 18.

Each arm 32C includes a bracket portion 32*d* that protrudes outward in the radial direction of the refrigerant tank 11 from the outer circumferential surface 11*g* of the refrigerant tank 11, in the second end 32*e*.

The bracket portions 32*d* of the arm 32C on the beam input port 17 side and the arm 32C on the beam output port 18 side face each other with a gap in the circumferential direction of the refrigerant tank 11.

Each arm displacing device 35A includes a gap adjusting member 38 that adjusts a gap between the bracket portion 32*d* of the arm 32C on the beam input port 17 side and the bracket portion 32*d* of the arm 32C on the beam output port 18 side. For example, a screw 39 can be used as the gap adjusting member 38. By rotating the screw 39 about an axis, the bracket portions 32*d* of the arms 32C are brought into close to each other or are separated from each other.

When the bracket portions 32*d* of the arms 32C are brought into close to each other or are separated from each other by the gap adjusting member 38, each arm 32C swings about the shaft 33.

Specifically, when the bracket portions 32*d* of the arms 32C are separated from each other, the second end 32*e* of each arm 32C is displaced in a direction in which the second end is separated from the outer circumferential surface 11*g* of the refrigerant tank 11. Then, each arm 32C swings about the shaft 33, the first end 32*a* is displaced in a direction in which the first end approaches the outer circumferential surface 11*g* of the refrigerant tank 11, and thus the first ends 32*a* press the flange 17*a* of the beam input port 17 and the flange 18*a* of the beam output port 18 in the particle passage direction of the charged particle beam B.

When the bracket portions 32*d* of the arms 32C are brought into close to each other by the gap adjusting member 38, the second end 32*e* of each arm 32C is displaced in a direction in which the second end approaches the outer circumferential surface 11*g* of the refrigerant tank 11. Then, the arm 32C swings about the shaft 33, the first end 32*a* is displaced in a direction in which the first end is separated from the outer circumferential surface 11*g* of the refrigerant tank 11, and a force for pressing the flange 17*a* of the beam input port 17 and the flange 18*a* of the beam output port 18 in the particle passage direction of the charged particle beam B is decreased.

In this way, it is possible to adjust the gap between the flange 17*a* of the beam input port 17 and the flange 18*a* of the beam output port 18, particularly, the beam acceleration gap G.

Third Modified Example of Second Embodiment

In the second embodiment, the arms 32A are disposed on the opposite sides in the circumferential direction in each of the flange 17*a* of the beam input port 17 and the flange 18*a* of the beam output port 18, but the invention is not limited thereto.

Figure 10:
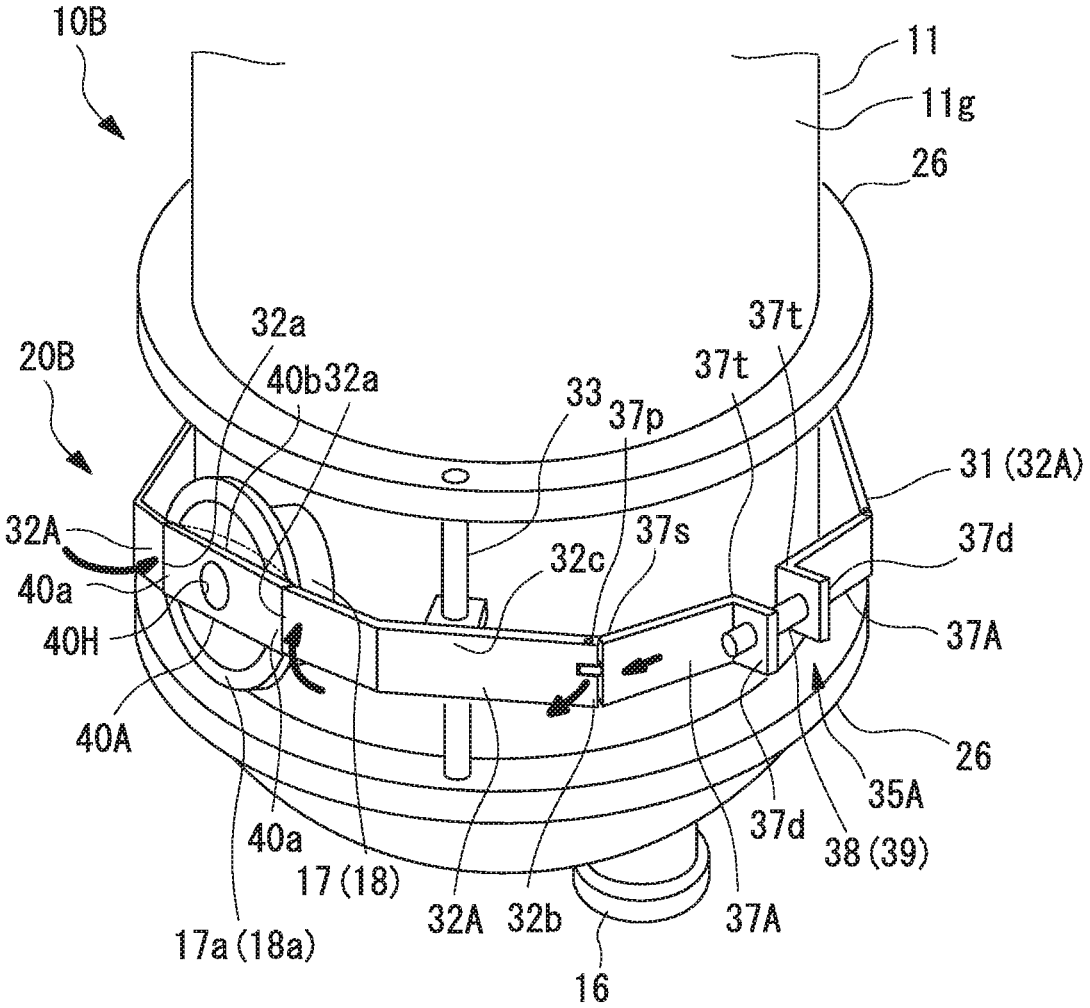
FIG. 10 is a perspective view showing a resonance frequency tuning mechanism in a third modified example of the second embodiment of the superconducting accelerator.

FIG. 10 is a perspective view showing a resonance frequency tuning mechanism in a third modified example of the second embodiment of the superconducting accelerator.

As shown in FIG. 10, arms 32A may be disposed on the opposite sides in the circumferential direction in each of the flange 17*a* of the beam input port 17 and the flange 18*a* of the beam output port 18, and the first ends 32*a* of the arms 32A may be connected by a pressing plate 40A having flexibility. An aperture 40H serving as a passage of a charged particle beam B is formed in the pressing plate 40A.

According to this configuration, by rotating the screw 39 in each gap adjusting member 38 disposed on the opposite sides in the diameter direction of the refrigerant tank 11, the push arms 37A are displaced and the arms 32A swing. Then, the pressing plate 40A is deflected with the displacement of the first ends 32*a* of the arms 32A. Specifically, the arms 32A swing about the shafts 33 and the first ends 32*a* are displaced in a direction in which the first ends approach the outer circumferential surface 11*g* of the refrigerant tank 11. Then, a central portion 40*b* of the pressing plate 40A is deflected to protrude in a direction in which the central portion approaches the outer circumferential surface 11*g* of the refrigerant tank 11 with respect to the opposite ends 40*a* and 40*a* thereof, and the flange 17*a* of the beam input port 17 and the flange 18*a* of the beam output port 18 are pressed in the particle passage direction of the charged particle beam B.

When the arms 32A swing about the shafts 33 by the gap adjusting member 38 and the first ends 32*a* are displaced in a direction in which the first ends are separated from the outer circumferential surface 11*g* of the refrigerant tank 11, the amount of deflection of the pressing plate 40A is decreased and the central portion 40*b* of the pressing plate 40A is displaced in a direction in which the central portion is separated from the outer circumferential surface 11*g* of the refrigerant tank 11. Accordingly, a force for pressing the flange 17*a* of the beam input port 17 and the flange 18*a* of the beam output port 18 in the particle passage direction of the charged particle beam B is decreased.

In this way, it is possible to adjust the gap between the flange 17*a* of the beam input port 17 and the flange 18*a* of the beam output port 18, particularly, the beam acceleration gap G.

Fourth Modified Example of Second Embodiment

In the third modified example of the second embodiment, the first ends 32*a* of the arms 32A are connected by the pressing plate 40A and the central portion 40*b* of the pressing plate 40A is deflected to protrude in the direction in which the central portion approaches the outer circumferential surface 11*g* of the refrigerant tank 11, but the invention is not limited thereto.

Figure 11:
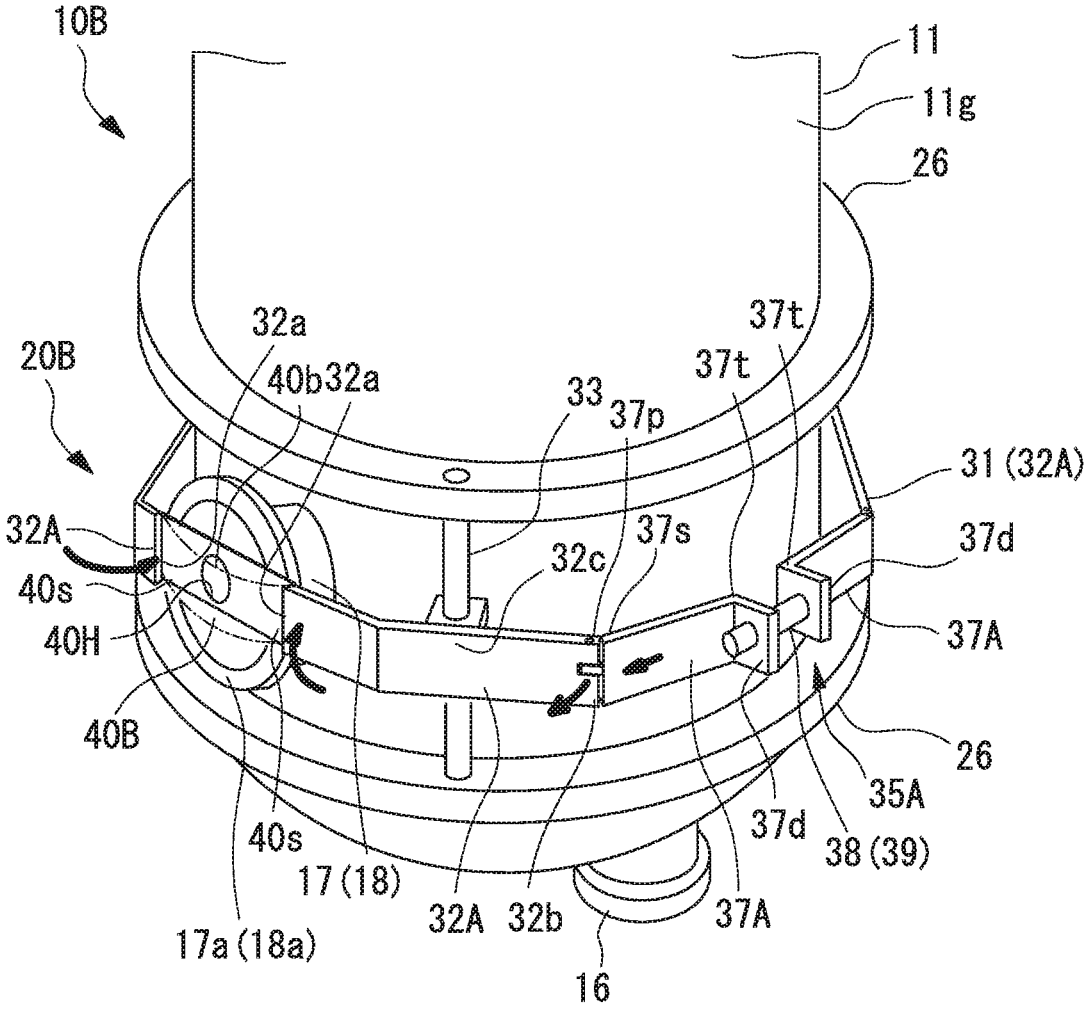
FIG. 11 is a perspective view showing a resonance frequency tuning mechanism in a fourth modified example of the second embodiment of the superconducting accelerator.

FIG. 11 is a perspective view showing a resonance frequency tuning mechanism in a fourth modified example of the second embodiment of the superconducting accelerator.

As shown in FIG. 11, arms 32A may be disposed on the opposite sides in the circumferential direction in each of the flange 17*a* of the beam input port 17 and the flange 18*a* of the beam output port 18, and a pressing plate 40B having flexibility may be disposed between the first ends 32*a* of the arms 32A.

According to this configuration, by rotating the screw 39 in each of the gap adjusting members 38 disposed on the opposite sides in the diameter direction of the refrigerant tank 11, the first ends 32*a* of the arms 32A are displaced in the direction in which the first ends approach the outer circumferential surface 11*g* of the refrigerant tank 11. Accordingly, opposite end portions 40*s* of the pressing plate 40B are deflected to protrude in the direction in which the ends approach the outer circumferential surface 11*g* of the refrigerant tank 11 with respect to the central portion 40*b* thereof, and the flange 17*a* of the beam input port 17 and the flange 18*a* of the beam output port 18 are pressed in the particle passage direction of the charged particle beam B.

Fifth Modified Example of Second Embodiment

In the third and fourth modified examples of the second embodiment, the flange 17*a* of the beam input port 17 and the flange 18*a* of the beam output port 18 are pressed by deflecting the pressing plate 40A and the pressing plate 40B, but the invention is not limited thereto.

Figure 12:
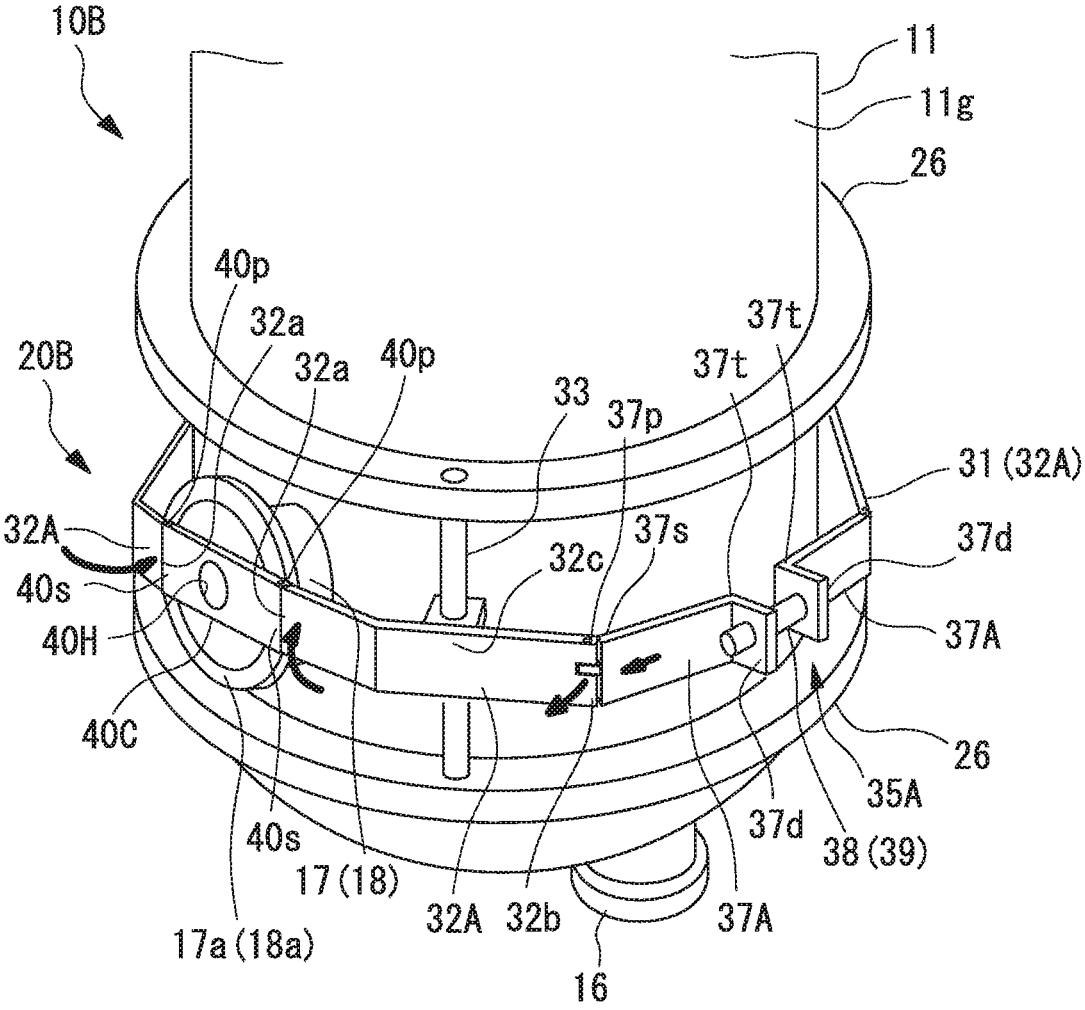
FIG. 12 is a perspective view showing a resonance frequency tuning mechanism in a fifth modified example of the second embodiment of the superconducting accelerator.

FIG. 12 is a perspective view showing a resonance frequency tuning mechanism in a fifth modified example of the second embodiment of the superconducting accelerator.

As shown in FIG. 12, arms 32A may be disposed on the opposite sides in the circumferential direction in each of the flange 17*a* of the beam input port 17 and the flange 18*a* of the beam output port 18, and a connection plate 40C may be disposed between the first ends 32*a* of the arms 32A. Opposite ends 40*s* of the connection plate 40C are rotatably connected to the first ends 32*a* of the arms 32A via a hinge pin 40*p*.

According to this configuration, by rotating the screw 39 in each of the gap adjusting members 38 disposed on the opposite sides in the diameter direction of the refrigerant tank 11, the first ends 32*a* of the arms 32A are displaced in the direction in which the first ends approach the outer circumferential surface 11*g* of the refrigerant tank 11. Accordingly, opposite end portions 40*s* of the connection plate 40C are displaced along with the first ends 32*a* of the arms 32A, and the flange 17*a* of the beam input port 17 and the flange 18*a* of the beam output port 18 are pressed in the particle passage direction of the charged particle beam B.

Other Modified Examples

The invention is not limited to the above-mentioned embodiments, and includes various modifications of the above-mentioned embodiments without departing from the gist of the invention. That is, specific shapes or configurations described in the embodiments are only examples and can be appropriately modified.

For example, in the first and second embodiments, the flange portions 26 are disposed above and below the resonance frequency tuning mechanisms 20A and 20B and the flange portion 26 extend continuously over the whole circumferential in the circumferential direction of the refrigerant tank 11, but the invention is not limited thereto.

Figure 13:
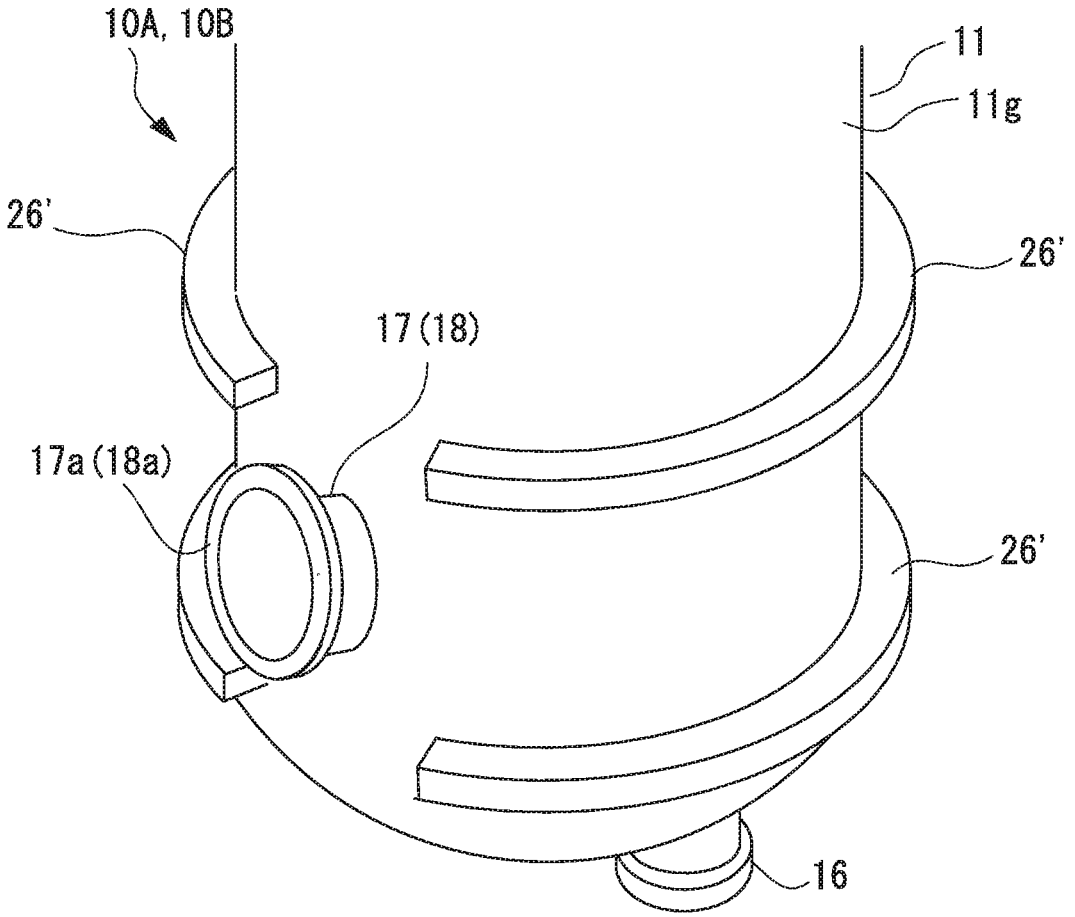
FIG. 13 is a perspective view showing a modified example of a flange portion of which is a refrigerant tank is provided.
Figure 14:
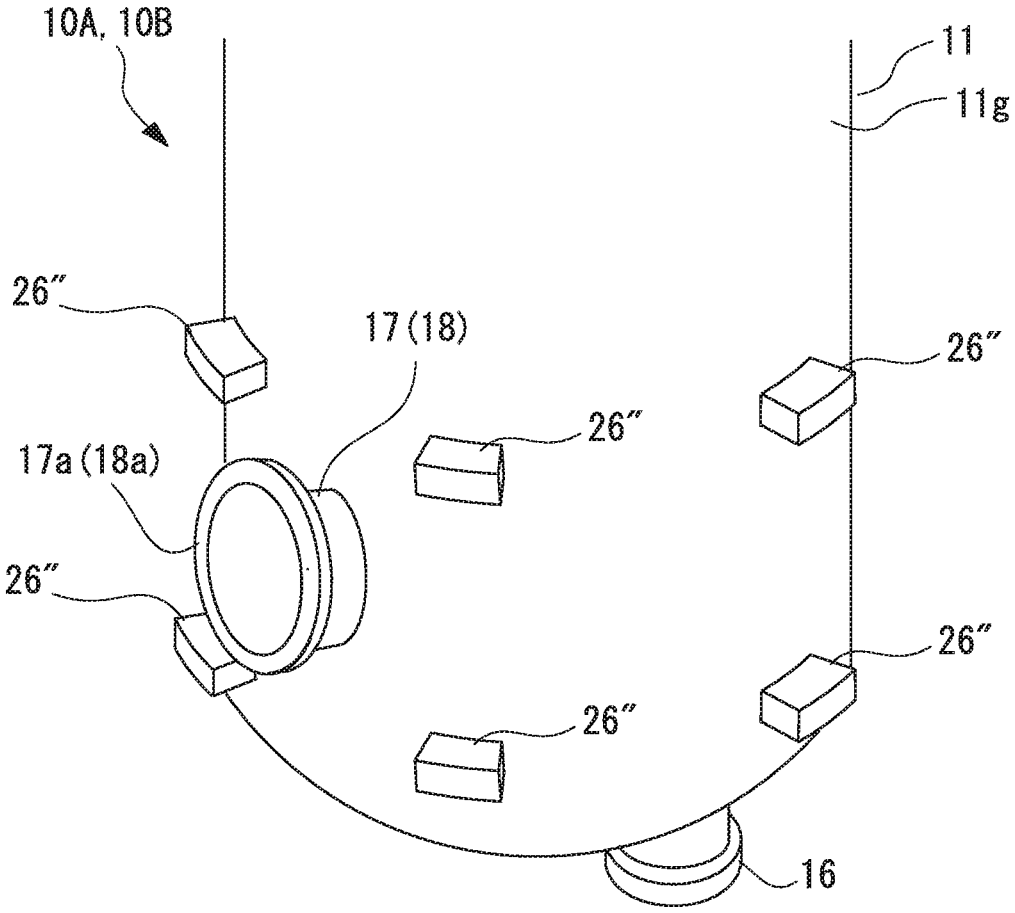
FIG. 14 is a perspective view showing an example of a support protrusion portion which is provided in a refrigerant tank.

FIG. 13 is a perspective view showing a modified example of the flange portions which are disposed in the refrigerant tank. FIG. 14 is a perspective view showing an example of a support protrusion portion which is disposed in the refrigerant tank.

As shown in FIG. 13, a flange portion (a support protrusion portion) 26' may be disposed in only a part of the circumferential direction. As shown in FIG. 14, a support protrusion portion 26" may be disposed intermittently at intervals in the circumferential direction of the refrigerant tank 11 and may be disposed in a block shape in only parts supporting the pulleys 23B or the shafts 33.

The refrigerant tanks 11 shown in FIGS. 13 and 14 may include the resonance frequency tuning mechanisms 20A and 20B described in the first and second embodiments.

In the first and second embodiments, the resonance frequency tuning mechanisms 20A and 20B are provided in the coaxial quarter-wave superconducting accelerators 10A and 10B, but the invention is not limited thereto.

Figure 15:
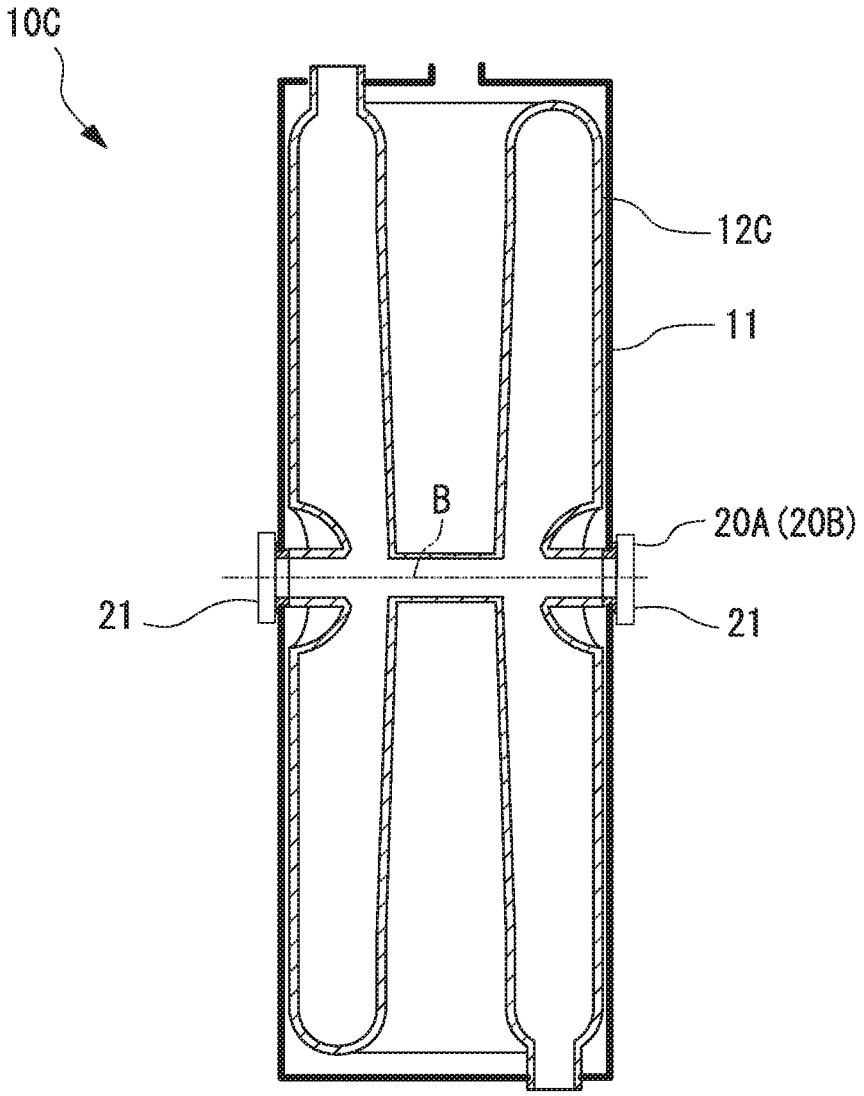
FIG. 15 is a perspective view showing another example of the superconducting accelerator to which the resonance frequency tuning mechanism can be applied.

As shown in FIG. 15, the resonance frequency tuning mechanisms 20A and 20B may be provided in a half-wave superconducting accelerator 10C with the opposite ends in the particle passage direction of a charged particle beam B of the acceleration cavity 12C interposed therebetween.

Figure 16:
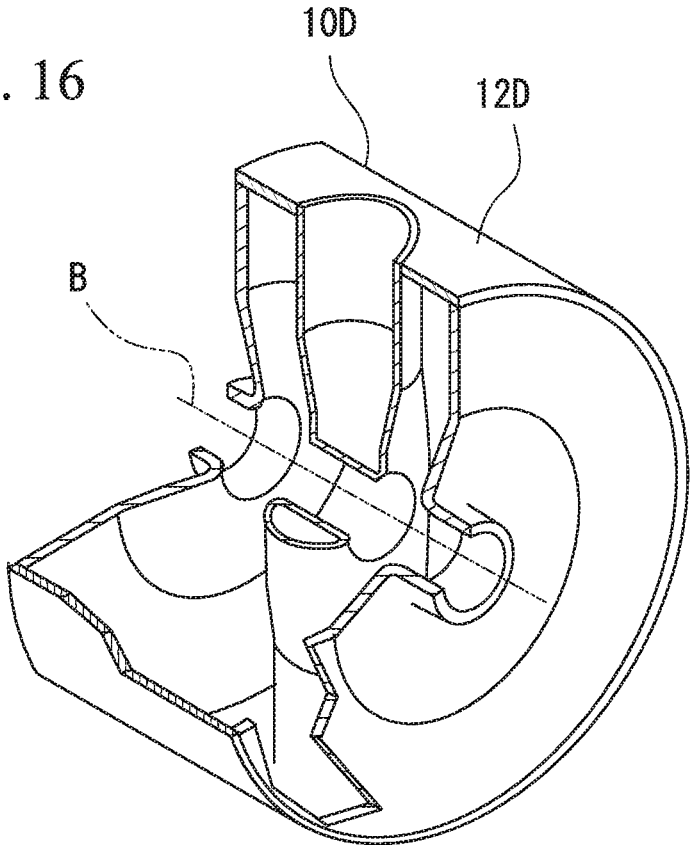
FIG. 16 is a perspective view showing another example of the superconducting accelerator to which the resonance frequency tuning mechanism can be applied.
Figure 17:
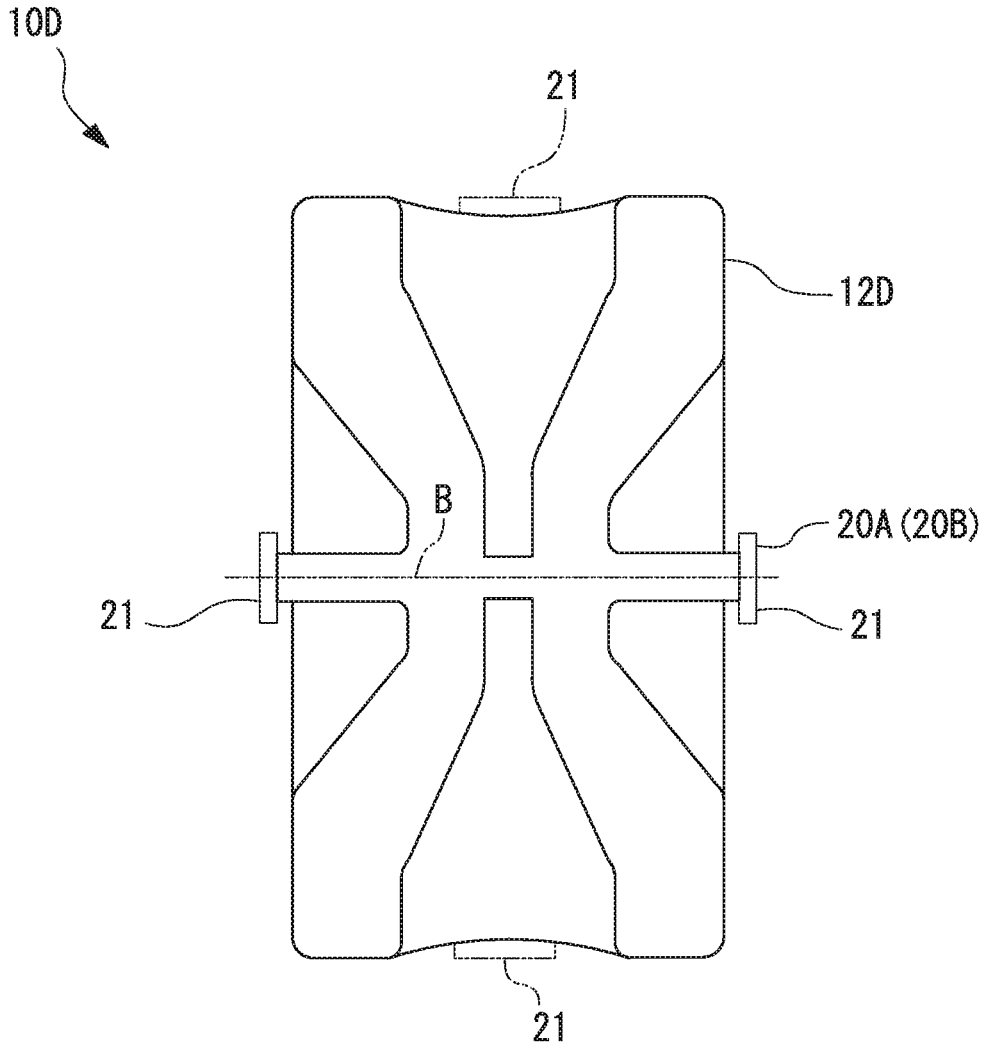
FIG. 17 is a diagram showing an example in which a resonance frequency tuning mechanism is provided in the superconducting accelerator.

As shown in FIGS. 16 and 17, similarly, the resonance frequency tuning mechanisms 20A and 20B may be provided in a spoke type superconducting accelerator 10D with the opposite ends in the particle passage direction of a charged particle beam B of the acceleration cavity 12C interposed therebetween.

As indicated by a two-point chain line in FIG. 17, in case of the spoke type superconducting accelerator 10D, the resonance frequency tuning mechanisms 20A and 20B may be provided to press the acceleration cavity 12D with the opposite ends in a diameter direction perpendicular to the particle passage direction of the charged particle beam B instead of pressing the acceleration cavity 12D with the resonance frequency tuning mechanisms 20A and 20B with the opposite ends in the particle passage direction of the charged particle beam B interposed therebetween. In addition, the resonance frequency tuning mechanisms 20A and 20B that press the acceleration cavity from the opposite ends in the diameter direction perpendicular to the particle passage direction of the charged particle beam B and the resonance frequency tuning mechanisms 20A and 20B that press the acceleration cavity from the opposite ends in the particle passage direction of the charged particle beam B may be used together.

Figure 18:
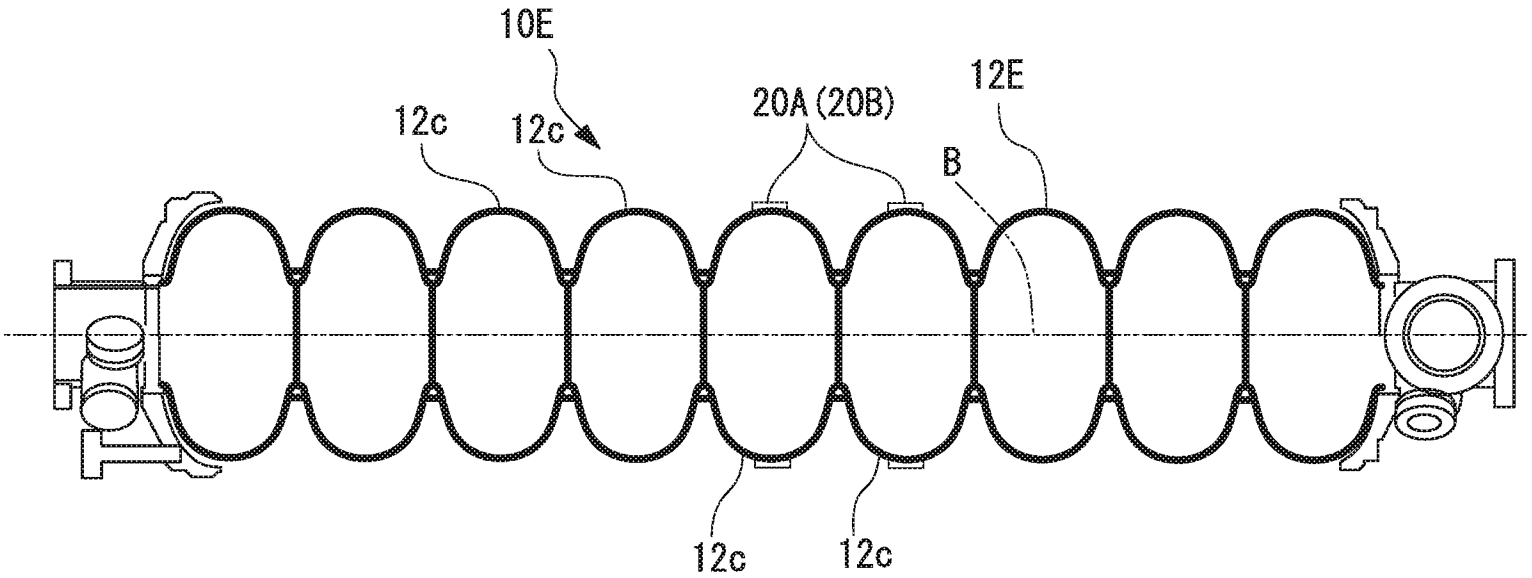
FIG. 18 is a perspective view showing another example of the superconducting accelerator to which the resonance frequency tuning mechanism can be applied.

As shown in FIG. 18, a superconducting accelerator 10D including acceleration cavities 12E, each of which repeats an increase in diameter and a decrease in diameter in the beam axis direction of a charged particle beam B may be provided with the resonance frequency tuning mechanisms 20A and 20B that press each cell 12*c* of the acceleration cavities 12E to be interposed between the opposite ends in the diameter direction perpendicular to the particle passage direction of the charged particle beam B.

REFERENCE SIGNS LIST

10A to 10D SUPERCONDUCTING ACCELERATOR
11 REFRIGERANT TANK
11*a* TOP SURFACE
11*b* BOTTOM SURFACE
11*f* INNER CIRCUMFERENTIAL SURFACE
11*g* OUTER CIRCUMFERENTIAL SURFACE
12, 12C, 12D and 12E ACCELERATION CAVITY
12*c* CELL
12*f* OUTER CONDUCTOR SURFACE
13 STEM
13*c* DRIFT TUBE
14 REFRIGERANT SUPPLY PORT
15 CLEANING PORT
16 INPUT COUPLER PORT
17 BEAM INPUT PORT
17*a* FLANGE
18 BEAM OUTPUT PORT
18*a* FLANGE
19 BEAM FLOW TUBE PORTION
20A and 20B RESONANCE FREQUENCY TUNING MECHANISM
21 PRESSING MEMBER
21*a* TOP END
21*b* BOTTOM END
21*h* APERTURE
22 WIRE (TENSILE MEMBER)
22A WIRE
22*a* WIRE FIXING POINT
23A, 23B PULLEY
23*c* SHAFT
24 BRACKET
25 TENSION ADJUSTOR

26 and 26' FLANGE PORTION (SUPPORT PROTRUSION PORTION)
26" SUPPORT PROTRUSION PORTION
27 WIRE HOLDING PLATE
27*a* TOP END
27*b* BOTTOM END
27*h* SCREW INSERTION HOLE
27*n* HOLE
28 GAP ADJUSTING MEMBER
29 SCREW
29*a* HEAD PORTION
29*b* SHAFT PORTION
29*g* WORM GEAR
29P PIEZOELECTRIC ELEMENT
31 PRESSING MEMBER
32A, 32B and 32C ARM
32*a* FIRST END
32*b* SECOND END
32*c* INTERMEDIATE PORTION
32*d* BRACKET PORTION
32*e* SECOND END
33 SHAFT (SUPPORT SHAFT)
35A ARM DISPLACING DEVICE
37A and 37B PUSH ARM
37*d* BRACKET PORTION
37*p* PIN
37*s* FIRST END
37*t* SECOND END
37*v* FIRST END
37*w* SECOND END
38 GAP ADJUSTING MEMBER
39 SCREW
40A PRESSING PLATE
40B PRESSING PLATE
40C CONNECTION PLATE
40*a* END
40*b* CENTRAL PORTION
40*p* HINGE PIN
40*s* OPPOSITE ENDS
A SPACE
B CHARGED PARTICLE BEAM
C CENTER AXIS
G BEAM ACCELERATION GAP
S GAP

The invention claimed is:

1. A superconducting accelerator comprising:

an acceleration cavity in which a space to accelerate a charged particle beam in a superconductive state is formed;

a refrigerant tank positioned at an outer circumference of the acceleration cavity, a gap between the refrigerant tank and the acceleration cavity accommodated in the refrigerant tank being filled with a refrigerant for cooling the acceleration cavity;

a pair of pressing members provided to an outer circumference of the refrigerant tank so as to be respectively positioned at both side ends of the acceleration cavity in a direction of a beam axis of the charged particle beam or at both ends of the acceleration cavity in a direction perpendicular to the beam axis;

a tensile member provided so as to be continuously wound around the outer circumference of the refrigerant tank and configured to generate a tensile force in a direction in which the pressing members are brought come into close each other; and a tension adjustor configured to adjust the tensile force generated by the tensile member.

2. The superconducting accelerator according to claim 1, wherein the tensile member is a wire, and a plurality of pulleys on which the wire is put are positioned at the outer circumference of the refrigerant tank at intervals in a circumferential direction of the refrigerant tank.

3. The superconducting accelerator according to claim 2, wherein a support protrusion portion protruded outward from the outer circumference of the refrigerant tank and configured to support the pulleys in a rotatable manner is positioned at the outer circumference of the refrigerant tank.

4. The superconducting accelerator according to claim 3, wherein the support protrusion portion is formed on the outer circumference of the refrigerant tank so as to be continuous in the circumferential direction of the refrigerant tank.

5. The superconducting accelerator according to claim 3, wherein the pressing members are provided with the pulleys.

6. The superconducting accelerator according to claim 4, wherein the pressing members are provided with the pulleys.

7. The superconducting accelerator according to claim 2, wherein the pressing members are provided with the pulleys.

8. A superconducting accelerator comprising:

an acceleration cavity in which a space to accelerate a charged particle beam in a superconductive state is formed;

a refrigerant tank positioned at an outer circumference of the acceleration cavity, a gap between the refrigerant tank and the acceleration cavity accommodated in the refrigerant tank being filled with a refrigerant for cooling the acceleration cavity;

a pair of arms provided to an outer circumference of the refrigerant tank so as to be respectively positioned at both side ends of the acceleration cavity in a direction of a beam axis of the charged particle beam or at both ends of the acceleration cavity in a direction perpendicular to the beam axis, the arms being supported in a swingable manner around a support shaft disposed on the outer circumference of the refrigerant tank, and first ends of the arms are disposed so as to face the both ends of the acceleration cavity; and an arm displacing device configured to displace second ends of the arms in a direction in which the second ends are separated from each other thereby pressing the both ends of the acceleration cavity with the first ends of the arms.

9. The superconducting accelerator according to claim 8, wherein each of the arms is extending from both ends of the acceleration cavity in the direction of the beam axis of the charged particle beam or from both ends of the acceleration cavity in the direction perpendicular to the beam axis to opposite sides in a circumferential direction of the refrigerant tank.

10. The superconducting accelerator according to claim 8, wherein a support protrusion portion protruded outward from the outer circumference of the refrigerant tank and configured to support the support shaft is positioned at the outer circumference of the refrigerant tank.

11. The superconducting accelerator according to claim 10, wherein the support protrusion portion is formed on the outer circumference of the refrigerant tank so as to be continuous in the circumferential direction of the refrigerant tank.

12. The superconducting accelerator according to claim 9, wherein a support protrusion portion protruded outward from the outer circumference of the refrigerant tank and configured to support the support shaft is positioned at the outer circumference of the refrigerant tank.

13. The superconducting accelerator according to claim 12, wherein the support protrusion portion is formed on the outer circumference of the refrigerant tank so as to be continuous in the circumferential direction of the refrigerant tank.

* * * * *